US011970752B2

(12) United States Patent
Takeda et al.

(10) Patent No.: US 11,970,752 B2
(45) Date of Patent: Apr. 30, 2024

(54) STEEL SHEET

(71) Applicant: NIPPON STEEL CORPORATION, Tokyo (JP)

(72) Inventors: Kengo Takeda, Tokyo (JP); Hiroyuki Kawata, Tokyo (JP); Takafumi Yokoyama, Tokyo (JP); Katsuya Nakano, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 415 days.

(21) Appl. No.: 17/426,592

(22) PCT Filed: Mar. 12, 2020

(86) PCT No.: PCT/JP2020/010937
§ 371 (c)(1),
(2) Date: Jul. 28, 2021

(87) PCT Pub. No.: WO2020/203158
PCT Pub. Date: Oct. 8, 2020

(65) Prior Publication Data

US 2022/0282351 A1 Sep. 8, 2022

(30) Foreign Application Priority Data

Mar. 29, 2019 (JP) ..... 2019-068611

(51) Int. Cl.
*C21D 9/46* (2006.01)
*C21D 8/02* (2006.01)
(Continued)

(52) U.S. Cl.
CPC ..... *C21D 9/46* (2013.01); *C21D 8/0226* (2013.01); *C21D 8/0236* (2013.01);
(Continued)

(58) Field of Classification Search
CPC ... C21D 1/19; C21D 1/22; C21D 1/25; C21D 1/26; C21D 2211/001; C21D 2211/002;
(Continued)

(56) References Cited

U.S. PATENT DOCUMENTS

2006/0137769 A1 6/2006 Yuse et al.
2013/0048151 A1 2/2013 Kawamura et al.
(Continued)

FOREIGN PATENT DOCUMENTS

IN 201502630 6/2016
IN 201637027242 8/2016
(Continued)

*Primary Examiner* — Jenny R Wu
(74) *Attorney, Agent, or Firm* — Birch, Stewart, Kolasch & Birch, LLP

(57) ABSTRACT

Provided are: a steel sheet having a high strength and excellent hydrogen embrittlement resistance; and a method of producing the same. The steel sheet has prescribed chemical composition and structure, in which a standard deviation σ of Mn concentration satisfies $\sigma \geq 0.15\ Mn_{ave}$ (wherein, $Mn_{ave}$ represents an average Mn concentration) and a region with a Mn concentration of higher than ($Mn_{ave}$+ 1.3σ) has a circle-equivalent diameter of less than 10.0 μm. The method of producing the steel sheet includes: the hot rolling step that includes finish rolling a slab having a prescribed chemical composition under prescribed conditions; the step of coiling the thus obtained hot-rolled steel sheet at a coiling temperature of 450 to 700° C.; and the step of cold rolling the hot-rolled steel sheet and subsequently annealing this steel sheet at 800 to 900° C.

2 Claims, 1 Drawing Sheet

(51) Int. Cl.

| | |
|---|---|
| ***C22C 38/00*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/60*** | (2006.01) |

(52) U.S. Cl.
CPC ..... *C21D 8/0273* (2013.01); *C22C 38/001* (2013.01); *C22C 38/002* (2013.01); *C22C 38/005* (2013.01); *C22C 38/008* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/60* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search
CPC ..... C21D 2211/005; C21D 2211/008; C21D 2211/009; C21D 8/005; C21D 8/0226; C21D 8/0231; C21D 8/0236; C21D 8/0247; C21D 8/0263; C21D 8/0273; C21D 9/46; C22C 38/001; C22C 38/002; C22C 38/005; C22C 38/008; C22C 38/02; C22C 38/04; C22C 38/06; C22C 38/12; C22C 38/42; C22C 38/44; C22C 38/46; C22C 38/48; C22C 38/50; C22C 38/52; C22C 38/54; C22C 38/58; C22C 38/60
See application file for complete search history.

(56) References Cited

U.S. PATENT DOCUMENTS

| | | | |
|---|---|---|---|
| 2014/0027022 | A1 | 1/2014 | Yokoi et al. |
| 2019/0071744 | A1 | 3/2019 | Hasegawa et al. |
| 2019/0153575 | A1 | 5/2019 | Shibata et al. |

FOREIGN PATENT DOCUMENTS

| | | | |
|---|---|---|---|
| IN | 201817038645 | | 1/2019 |
| JP | 2006-207019 | A | 8/2006 |
| JP | 2010-138489 | A | 6/2010 |
| JP | 2010-215958 | A | 9/2010 |
| JP | 2011-179030 | A | 9/2011 |
| JP | 2016-50343 | A | 4/2016 |
| JP | 2016-153524 | A | 8/2016 |
| WO | WO 2012/141297 | A1 | 10/2012 |
| WO | WO 2017/168962 | A1 | 10/2017 |

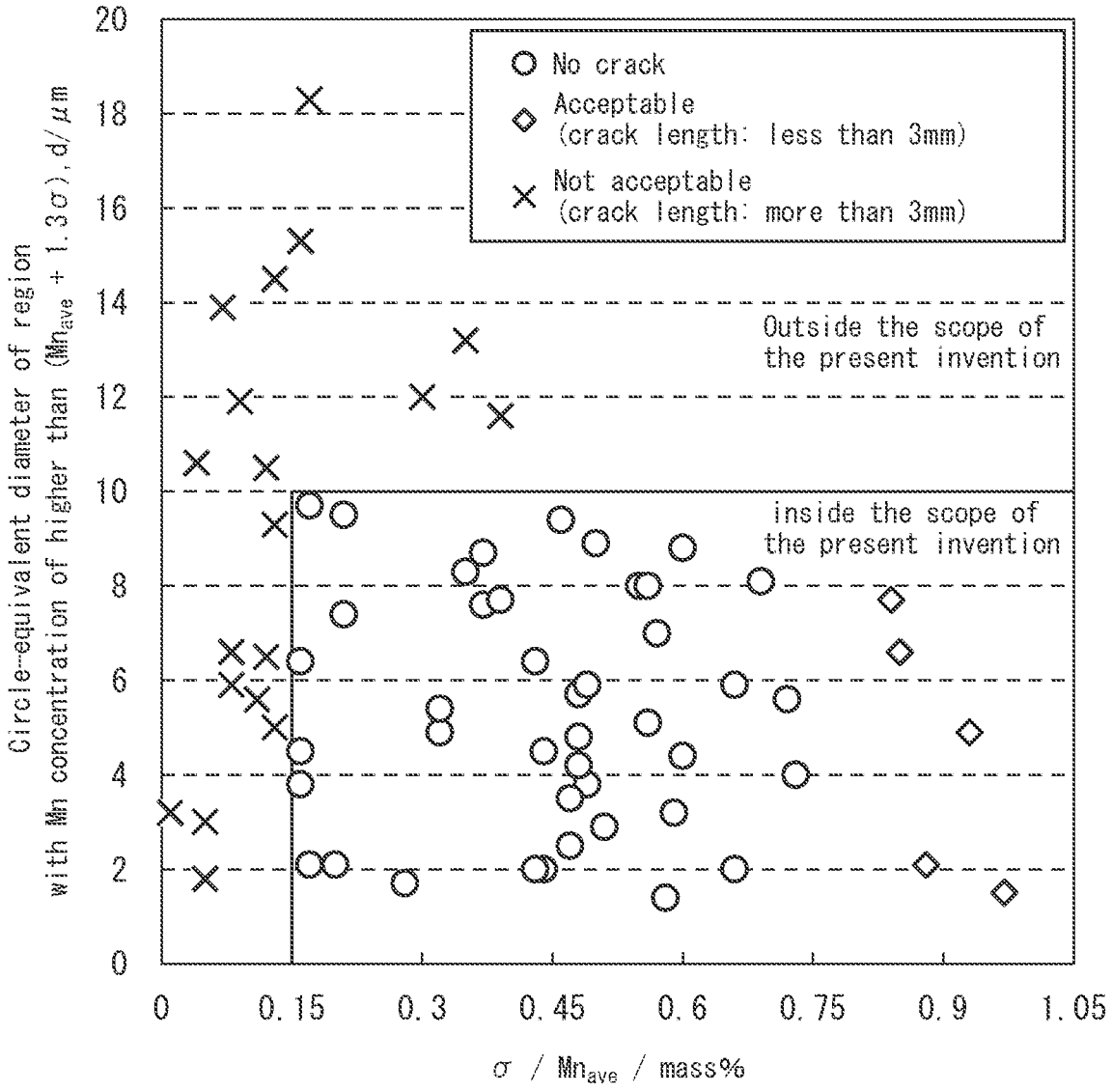
No crack
Acceptable
(crack length: less than 3mm)
Not acceptable
(crack length: more than 3mm)
Outside the scope of the present invention
inside the scope of the present invention
Circle-equivalent diameter of region with Mn concentration of higher than (Mn_ave + 1.3σ), d/μm
σ / Mn_ave / mass%
0
2
4
6
8
10
12
14
16
18
20
0
0.15
0.3
0.45
0.6
0.75
0.9
1.05

STEEL SHEET

FIELD

The present invention relates to a steel sheet and a method of producing the same. More particularly, the present invention relates to a high-strength steel sheet having excellent hydrogen embrittlement resistance (also referred to as "delayed fracture resistance"), and a method of producing the same.

BACKGROUND

There is a strong demand for a fundamental solution to hydrogen embrittlement in ultrahigh-strength steel sheets which contains martensite as a main structure and has a tensile strength of 1,300 MPa or higher. Hydrogen embrittlement is a phenomenon in which hydrogen entering steel is segregated to martensite grain boundaries to cause embrittlement of the grain boundaries (reduction of the grain boundary strength) and cracks are formed as a result. The entry of hydrogen occurs even at room temperature; therefore, there is no method that completely suppresses the entry of hydrogen, and it is indispensable to modify the steel internal structure for fundamental resolution of this issue.

Numerous proposals have been previously made regarding the technology for improving the hydrogen embrittlement resistance of a high-strength steel sheet (see, for example, PTLs 1 to 5).

PTL 1 discloses an ultrahigh-strength thin steel sheet having excellent hydrogen embrittlement resistance and workability, wherein the steel sheet contains, by mass %, C: more than 0.25 to 0.60%, Si: 1.0 to 3.0%, Mn: 1.0 to 3.5%, P: 0.15% or less, S: 0.02% or less, Al: 1.5% or less (excluding 0%), Mo: 1.0% or less (excluding 0%), Nb: 0.1% or less (excluding 0%) and the balance of iron and unavoidable impurities, and after being stretch-worked at a working rate of 3%, the steel sheet has a metallographic structure which contains, by area ratio with respect to the whole structure, retained austenite structure: 1% or moer, a total of bainitic ferrite and martensite: 80% or more, and a total of ferrite and pearlite: 9% or less (including 0%), and in which crystal grains of the retained austenite have an average axial ratio (major axis/minor axis) of 5 or higher; and the steel sheet has a tensile strength of 1,180 MPa or higher. In PTL 1, the disclosure is directed only to the hydrogen embrittlement resistance with application of a stress of 1,000 MPa, and does not offer any technical solution or guideline with regard to the hydrogen embrittlement resistance with application of a higher stress.

PTL 2 discloses a high-strength steel sheet having a tensile strength of 1,500 MPa or higher, which contains 1.0% or more of (Si+Mn) as a steel component and in which: ferrite and carbides form layers as a main-phase structure; the carbides have an aspect ratio of 10 or higher; a layered structure with gaps of 50 nm or smaller between the layers has a volume ratio of 65% or higher with respect to the whole structure; the fraction of carbides which, among the carbides forming layers with ferrite, have an aspect ratio of 10 or higher and form an angle of 25° or smaller with respect to the rolling direction, is 75% or higher in terms of area ratio whereby the steel sheet has excellent bendability and delayed fracture resistance in a rolling direction. It is easy to assume that this steel sheet is strongly anisotropic and have poor formability of members by cold pressing since it is obtained by cold rolling, at a reduction ratio of 60% or higher (preferably 75% or higher), a steel sheet that has a Vickers hardness of HV 200 or higher and a structure in which: a pearlite structure constitutes a main phase; a ferrite phase in the remaining structure has a volume ratio of 20% or lower with respect to the whole structure; and the pearlite structure has a lamellar spacing of 500 nm or smaller.

PTL 3 discloses a cold-rolled steel sheet having a tensile strength of 1,470 MPa or higher and excellent bending workability and delayed fracture resistance, which contains, by mass %, C: 0.15 to 0.20%, Si: 1.0 to 2.0%, Mn: 1.5 to 2.5%, P: 0.020% or less, S: 0.005% or less, Al: 0.01 to 0.05%, N: 0.005% or less, Ti: 0.1% or less, Nb: 0.1% or less, B: 5 to 30 ppm, and the balance of Fe and unavoidable impurities, and has a metallographic structure in which a tempered martensite phase has a volume ratio of 97% or higher, and a retained austenite phase has a volume ratio of lower than 3%.

PTL 4 discloses an ultrahigh-strength thin cold-rolled steel sheet having excellent bendability and delayed fracture resistance, which contains, by mass %, C: 0.15 to 0.30%, Si: 0.01 to 1.8%, Mn: 1.5 to 3.0%, P: 0.05% or less, S: 0.005% or less, Al: 0.005 to 0.05%, N: 0.005% or less and the balance of Fe and unavoidable impurities, wherein the steel sheet has a steel sheet superficial soft portion satisfying a relationship of "(hardness of steel sheet superficial soft portion)/(hardness of steel sheet core portion) 0.8"; the steel sheet superficial soft portion has a ratio of 0.10 to 0.30 in terms of thickness with respect to the sheet thickness, and contains tempered martensite at a volume ratio of 90% or higher; the steel sheet core portion has a structure composed of tempered martensite; and the steel sheet has a tensile strength of 1,270 MPa or higher. In PTL 4, there is a problem for a low productivity since, in order to improve the delayed fracture characteristics, it is necessary to retain the steel sheet at 650° C. or 700° C. for at least 20 minutes in an atmosphere having a dew point of 15° C. or higher.

PTL 5 discloses an ultrahigh-strength steel sheet that has a tensile strength of 1,470 MPa or higher and is capable of exerting excellent delayed fracture resistance even at a cut end, the steel sheet having a component composition which contains, by mass %, C: 0.15 to 0.4%, Mn: 0.5 to 3.0%, Al: 0.001 to 0.10%, and the balance of iron and unavoidable impurities, wherein P, S and N of the unavoidable impurities are each limited to P: 0.1% or less, S: 0.01% or less, and N: 0.01% or less, and the steel sheet having a structure including, by area ratio with respect to the whole structure, martensite: 90% or more and retained austenite: 0.5% or more and the steel sheet containing a region where local Mn concentration is at least 1.1 times the Mn content of the whole steel sheet at an area ratio of 2% or higher, and the steel sheet having a tensile strength of 1,470 MPa or higher.

In addition to the above, for example, PTLs 6 to 8 each disclose a technology relating to a high-strength steel sheet.

CITATION LIST

Patent Literature

[PTL 1] JP 2006-207019 A
[PTL 2] JP 2010-138489 A
[PTL 3] JP 2010-215958 A
[PTL 4] JP 2011-179030 A
[PTL 5] JP 2016-153524 A
[PTL 6] WO 2012/141297
[PTL 7] JP 2016-050343 A
[PTL 8] WO 2017/168962

SUMMARY

Technical Problem

As described above, the segregation of hydrogen in steel to grain boundaries causes the hydrogen embrittlement, and it is believed that the segregation of hydrogen to grain boundaries can be inhibited by introducing stronger segregation sites than the grain boundaries. However, none of PTLs 1 to 8 adequately examined an improvement of the hydrogen embrittlement resistance from such a viewpoint; therefore, in the prior art, there is still room for improvement with regard to an improvement of the hydrogen embrittlement resistance.

In view of the above-described circumstances, an object of the present invention is to provide a steel sheet having a high strength and excellent hydrogen embrittlement resistance, and a method of producing the same.

Solution to Problem

The gist of the present invention is as follows.

(1) A steel sheet, having a chemical composition comprising, by mass %:

C: 0.15 to 0.40%;
Si: 0.01 to 2.00%;
Mn: 0.10 to 5.00%;
P: 0.0001 to 0.0200%;
S: 0.0001 to 0.0200%;
Al: 0.001 to 1.000%;
N: 0.0001 to 0.0200%;
Co: 0 to 0.50%;
Ni: 0 to 1.00%;
Mo: 0 to 1.00%;
Cr: 0 to 2.000%;
O: 0 to 0.0200%;
Ti: 0 to 0.500%;
B: 0 to 0.0100%;
Nb: 0 to 0.500%;
V: 0 to 0.500%;
Cu: 0 to 0.500%;
W: 0 to 0.100%;
Ta: 0 to 0.100%;
Sn: 0 to 0.050%;
Sb: 0 to 0.050%;
As: 0 to 0.050%;
Mg: 0 to 0.0500%;
Ca: 0 to 0.050%;
Y: 0 to 0.050%;
Zr: 0 to 0.050%;
La: 0 to 0.050%;
Ce: 0 to 0.050%; and
a balance of Fe and impurities,
wherein
the steel sheet comprises, by area ratio:
ferrite: 5.0% or less; and
a total of martensite and tempered martensite: 90.0% or more; wherein when there is a balance structure, the balance structure is composed of at least one of bainite, pearlite, and retained austenite;
a standard deviation a of Mn concentration satisfies a 0.15 $Mn_{ave}$ (wherein, $Mn_{ave}$ represents an average Mn concentration); and
a region with a Mn concentration of higher than ($Mn_{ave}$+1.3a) has a circle-equivalent diameter of less than 10.0 μm.

(2) The steel sheet according to the above-described (1), comprising one or more of:

Co: 0.01 to 0.50%;
Ni: 0.01 to 1.00%;
Mo: 0.01 to 1.00%;
Cr: 0.001 to 2.000%;
O: 0.0001 to 0.0200%;
Ti: 0.001 to 0.500%;
B: 0.0001 to 0.0100%;
Nb: 0.001 to 0.500%;
V: 0.001 to 0.500%;
Cu: 0.001 to 0.500%;
W: 0.001 to 0.100%;
Ta: 0.001 to 0.100%;
Sn: 0.001 to 0.050%;
Sb: 0.001 to 0.050%;
As: 0.001 to 0.050%;
Mg: 0.0001 to 0.0500%;
Ca: 0.001 to 0.050%;
Y: 0.001 to 0.050%;
Zr: 0.001 to 0.050%;
La: 0.001 to 0.050%; and
Ce: 0.001 to 0.050%.

Advantageous Effects of Invention

According to the present invention, a steel sheet having a high strength and excellent hydrogen embrittlement resistance, and a method of producing the same can be provided.

BRIEF DESCRIPTION OF DRAWING

FIG. 1 is a graph showing the relationship between the standard deviation of Mn concentration and the circle-equivalent diameter of Mn-concentrated region, which affect the hydrogen embrittlement resistance.

DESCRIPTION OF EMBODIMENTS

Embodiments of the present invention will now be described. It is noted here, however, the following descriptions are merely intended for exemplification of the embodiments of the present invention, and the present invention is not limited to the below-described embodiments.

<Steel Sheet>

The steel sheet according to one embodiment of the present invention has a chemical composition comprising, by mass %:

C: 0.15 to 0.40%;
Si: 0.01 to 2.00%;
Mn: 0.10 to 5.00%;
P: 0.0001 to 0.0200%;
S: 0.0001 to 0.0200%;
Al: 0.001 to 1.000%;
N: 0.0001 to 0.0200%;
Co: 0 to 0.50%;
Ni: 0 to 1.00%;
Mo: 0 to 1.00%;
Cr: 0 to 2.000%;
O: 0 to 0.0200%;
Ti: 0 to 0.500%;
B: 0 to 0.0100%;
Nb: 0 to 0.500%;
V: 0 to 0.500%;
Cu: 0 to 0.500%;
W: 0 to 0.100%;
Ta: 0 to 0.100%;
Sn: 0 to 0.050%;
Sb: 0 to 0.050%;
As: 0 to 0.050%;
Mg: 0 to 0.0500%;
Ca: 0 to 0.050%;
Y: 0 to 0.050%;
Zr: 0 to 0.050%;

La: 0 to 0.050%;

Ce: 0 to 0.050%; and a balance of Fe and impurities, wherein the steel sheet comprises, by area ratio:

ferrite: 5.0% or less; and a total of martensite and tempered martensite: 90.0% or more; wherein when there is a balance structure, the balance structure is composed of at least one of bainite, pearlite, and retained austenite;

a standard deviation a of Mn concentration satisfies a 0.15 $Mn_{ave}$ (wherein, $Mn_{ave}$ represents an average Mn concentration); and a region with a Mn concentration of higher than ($Mn_{ave}$+1.3a) has a circle-equivalent diameter of less than 10.0 μm.

As described above, the segregation of hydrogen in steel to grain boundaries causes the hydrogen embrittlement, and it is believed that segregation of hydrogen to grain boundaries can be inhibited by introducing stronger segregation sites than the grain boundaries. Meanwhile, segregation of hydrogen to grain boundaries occurs due to the presence of more "gaps" at the grain boundaries than in the grains. In other words, it is believed that incorporation of gaps larger than the grain boundaries would allow hydrogen to be segregated in these gaps, as a result of which segregation of hydrogen to the grain boundaries can be inhibited.

In view of the above, the present inventors conducted studies focusing on Mn as a stronger segregation site than a grain boundary. As a result, the present inventors discovered that, by micro-dispersing Mn-concentrated parts in the form of grains in a steel, hydrogen can be segregated not to grain boundaries but to the Mn-concentrated parts, and that, since microvoids are generated in the Mn-concentrated parts due to such segregation of hydrogen, hydrogen can be further segregated to the generated microvoids and, therefore, segregation of hydrogen to grain boundaries can be sufficiently inhibited to markedly improve the hydrogen embrittlement resistance of a steel sheet.

However, in the production of an ordinary steel sheet, it is extremely difficult to generate the above-described Mn-concentrated parts and microvoids in a steel as desired. Nevertheless, the present inventors further discovered that Mn-concentrated parts and microvoids can be generated in a steel and utilized for improving the hydrogen embrittlement resistance in the below-described manner.

(i) First, at the time of hot rolling, austenite grains (γ grains) after the completion of finish rolling are controled to be in the form of equiaxial grains.

(ii) After the finish rolling, quenching is performed in order to allow ferrite grains to be generated from the equiaxial γ grains. The reason for performing this quenching is to prevent impurity elements from being segregated to the grain boundaries since the segregation of impurity elements to the grain boundaries inhibits the generation of ferrite grains from the γ grains.

(iii) After the completion of the finish rolling under the above-described conditions, pearlite is generated in a period between cooling and coiling, and the formation of a band-like structure of pearlite is inhibited by fine ferrite grains generated from the equiaxial γ grains, thereby forming grain-form pearlite.

(iv) Since Mn strongly binds with cementite, during a period between after the completion of coiling and before cooling of the resulting coil to room temperature, Mn is concentrated to cementite in each isolated grain of pearlite.

(v) By optimizing the hot rolling conditions in this manner, a hot-rolled steel sheet in which Mn-concentrated parts are micro-dispersed in the form of grains is obtained.

(vi) After the hot rolling, a high-strength steel mainly composed of martensite, in which Mn-concentrated parts are micro-dispersed in the form of grains, is finally obtained through cold rolling and annealing processes.

(vii) In the use of this high-strength steel under a hydrogen embrittlement environment, first, hydrogen embrittlement cracking occurs in the Mn-concentrated parts. The cracks formed by this cracking propagate only in the Mn-concentrated parts. Therefore, at a steel cross-section after a hydrogen embrittlement treatment, microcracks (microvoids) exist in a manner that they correspond to the Mn-concentrated microparts and, by the generation of these microvoids, segregation of hydrogen to the prior γ grain boundaries in the steel sheet is inhibited, and an effect of releasing residual stress is exerted, as a result of which a steel having a high tensile strength and excellent hydrogen embrittlement resistance can be obtained.

Further, the present inventors conducted various studies to discover that it is difficult to produce the above-described steel sheet even if the hot-rolling conditions, the annealing conditions and the like are simply and individually devised, and that such a steel sheet can be produced only by achieving optimization in a so-called consistent process of the hot rolling and annealing step and the like, thereby completing the present invention. The steel sheet according to one embodiment of the present invention will now be described in more detail.

First, the reasons for restricting the chemical components of the steel sheet according to one embodiment of the present invention will be described. Hereinafter, "%" used for each component means "% by mass".

(C: 0.15 to 0.40%)

C is an element which inexpensively increases the tensile strength; therefore, the amount thereof to be added is adjusted in accordance with the target strength level. A C content of less than 0.15% not only is difficult to achieve in a steelmaking technology and leads to an increase in the cost, but also deteriorates the fatigue characteristics of welded parts. Accordingly, a lower limit value is set at 0.15% or more. The C content may be 0.16% or more, 0.18% or more, or 0.20% or more. When the C content is more than 0.40%, the hydrogen embrittlement resistance is deteriorated, and the weldability is impaired. Accordingly, an upper limit value is set at 0.40% or less. The C content may be 0.35% or less, 0.30% or less, or 0.25% or less.

(Si: 0.01 to 2.00%)

Si is an element which acts as a deoxidizer and affects the form of carbides and heat-treated retained austenite. In addition, it is effective to improve the elongation of steel by reducing the volume ratio of carbides existing in a steel component and utilizing retained austenite. An Si content of less than 0.01% makes it difficult to inhibit the generation of coarse oxides. The coarse oxides serve as the origin of the formation of cracks ahead of microvoids, and propagation of the thus formed cracks in the steel material causes deterioration of the hydrogen embrittlement resistance. Accordingly, a lower limit value is set at 0.01% or more. The Si content may be 0.05% or more, 0.10% or more, or 0.30% or more. When the Si content is more than 2.00%, concentration of Mn to carbides in the hot-rolled structure is inhibited, and the hydrogen embrittlement resistance is thus reduced.

Accordingly, an upper limit value is set at 2.00% or less. The Si content may be 1.80% or less, 1.60% or less, or 1.40% or less.

(Mn: 0.10 to 5.00%)

Mn is an element effective for improving the strength of the steel sheet. When the Mn content is less than 0.10%, this effect is not obtained. Accordingly, a lower limit value is set at 0.10% or more. The Mn content may be 0.30% or more, 0.50% or more, or 1.00% or more. When the Mn content is more than 5.00%, not only co-segregation of P and S is promoted but also the Mn concentration in those parts other than the concentrated parts is increased, as a result of which the hydrogen embrittlement resistance may be deteriorated. In addition, the corrosion resistance is reduced. Accordingly, an upper limit value is set at 5.00% or less. The Mn content may be 4.50% or less, 3.50% or less, or 3.00% or less.

(P: 0.0001 to 0.0200%)

P is an element which is strongly segregated at ferrite grain boundaries to facilitate embrittlement of the grain boundaries. The lower the P content, the more preferred it is. When the P content is less than 0.0001%, a long time is required for refining to increase the purity, and this leads to a significant increase in the cost. Accordingly, a lower limit value is set at 0.0001% or more. The P content may be 0.0005% or more, 0.0010% or more, or 0.0020% or more. When the P content is more than 0.0200%, the hydrogen embrittlement resistance is reduced due to grain boundary embrittlement. Accordingly, an upper limit value is set at 0.0200% or less. The P content may be 0.0180% or less, 0.0150% or less, or 0.0120% or less.

(S: 0.0001 to 0.0200%)

S is an element which generates non-metallic inclusions such as MnS in steel and causes a reduction in the ductility of a steel component. The lower the S content, the more preferred it is. When the S content is less than 0.0001%, a long time is required for refining to increase the purity, and this leads to a significant increase in the cost. Accordingly, a lower limit value is set at 0.0001% or more. The S content may be 0.0005% or more, 0.0010% or more, or 0.0020% or more. When the S content is more than 0.0200%, cracks are formed originating from non-metallic inclusions during cold working, and propagation of the cracks in the steel material occurs with a lower load stress as compared to the generation of microvoids; therefore, the effects of the present invention are not obtained, and the hydrogen embrittlement resistance is deteriorated. Accordingly, an upper limit value is set at 0.0200% or less. The S content may be 0.0180% or less, 0.0150% or less, or 0.0120% or less.

(Al: 0.001 to 1.000%)

Al is an element which acts as a deoxidizer of steel and stabilizes ferrite, and Al is added as required. When the Al content is less than 0.001%, the effect of the addition is not sufficiently obtained. Accordingly, a lower limit value is set at 0.001% or more. The Al content may be 0.005% or more, 0.010% or more, or 0.020% or more. When the Al content is more than 1.000%, coarse Al oxide is generated, and cracks are formed ahead of microvoids on this coarse oxide and propagate in the steel material, as a result of which the hydrogen embrittlement resistance is deteriorated. Accordingly, an upper limit value is set at 1.000% or less. The Al content may be 0.950% or less, 0.900% or less, or 0.800% or less.

(N: 0.0001 to 0.0200%)

N is an element which forms coarse nitrides in the steel sheet and thereby reduces the hydrogen embrittlement resistance of the steel sheet. N is also an element which causes generation of blow-holes in welding. An N content of less than 0.0001% leads to a significant increase in the production cost. Accordingly, a lower limit value is set at 0.0001% or more. The N content may be 0.0005% or more, 0.0010% or more, or 0.0020% or more. When the N content is more than 0.0200%, coarse nitrides are generated, and cracks are formed ahead of microvoids on the generated nitrides and propagate in the steel material, as a result of which the hydrogen embrittlement resistance is deteriorated. In addition, the generation of blow-holes become prominent. Accordingly, an upper limit value is set at 0.0200% or less. The N content may be 0.0180% or less, 0.0160% or less, or 0.0120% or less.

The basic chemical composition of the steel sheet according to one embodiment of the present invention is as described above. The steel sheet may further contain the following elements as required. The steel sheet may contain the following elements in place of a part of the balance of Fe.

(Co: 0 to 0.50%)

Co is an element effective for controlling the form of carbides and improving the strength, and it is added as required. When the Co content is less than 0.01%, the effects of the addition are not obtained. Accordingly, a lower limit value is preferably set at 0.01% or more. The Co content may be 0.02% or more, 0.05% or more, or 0.10% or more. Further, a Co content of more than 0.50% causes prominent precipitation of coarse Co carbide, and cracks are formed originating from the coarse Co carbide; therefore, the hydrogen embrittlement resistance may be deteriorated. Accordingly, an upper limit value is set at 0.50% or less. The Co content may be 0.45% or less, 0.40% or less, or 0.30% or less.

(Ni: 0 to 1.00%)

Ni is a reinforcing element and is effective for improving the hardenability. In addition, Ni may be added since it improves the wettability and facilitates an alloying reaction. When the Ni content is less than 0.01%, these effects are not obtained. Accordingly, a lower limit value is preferably set at 0.01% or more. The Ni content may be 0.02% or more, 0.05% or more, or 0.10% or more. When the Ni content is more than 1.00%, the productivity in the production and in hot rolling may be adversely affected, or the hydrogen embrittlement resistance may be reduced. Accordingly, an upper limit value is set at 1.00% or less. The Ni content may be 0.90% or less, 0.80% or less, or 0.60% or less.

(Mo: 0 to 1.00%)

Mo is an element effective for improving the strength of the steel sheet. Further, Mo is an element which has an effect of inhibiting ferrite transformation that occurs during a heat treatment performed in a continuous annealing equipment or continuous hot-dip galvanizing equipment. When the Mo content is less than 0.01%, these effects are not obtained. Accordingly, a lower limit value is preferably set at 0.01% or more. The Mo content may be 0.02% or more, 0.05% or more, or 0.08% or more. When the Mo content is more than 1.00%, the effect of inhibiting ferrite transformation is saturated. Accordingly, an upper limit value is set at 1.00% or less. The Mo content may be 0.90% or less, 0.80% or less, or 0.60% or less.

(Cr: 0 to 2.000%)

Similarly to Mn, Cr is an element which inhibits pearlite transformation and is effective for improving the steel strength, and Cr is added as required. When the Cr content is less than 0.001%, the effects of the addition are not obtained. Accordingly, a lower limit value is preferably set at 0.001% or more. The Cr content may be 0.005% or more, 0.010% or more, or 0.050% or more. When the Cr content is more than 2.000%, coarse Cr carbide may be formed in the center segregation site to cause deterioration of the hydrogen embrittlement resistance. Accordingly, an upper limit value is set at 2.000% or less. The Cr content may be 1.800% or less, 1.500% or less, or 1.000% or less.

(O: 0 to 0.0200%)

O forms oxides and deteriorates the hydrogen embrittlement resistance; therefore, the amount thereof to be added needs to be kept small. Particularly, the oxides often exist in the form of inclusions and, when such oxides exist on a punched end surface or a cut surface, notch-like defects and coarse dimples are formed on the end surface, as a result of which stress concentration is induced during severe working, and the workability is significantly deteriorated with such defects and dimples serving as the origin of crack formation. However, an O content of less than 0.0001% is not economically preferred since it leads to an excessively high cost. Accordingly, a lower limit value is preferably set at 0.0001% or more. The O content may be 0.0005% or more, 0.0010% or more, or 0.0015% or more. Meanwhile, when the O content is more than 0.0200%, the above-described tendency of workability deterioration is pronounced. Accordingly, an upper limit value is set at 0.0200% or less. The O content may be 0.0180% or less, 0.0150% or less, or 0.0100% or less.

(Ti: 0 to 0.500%)

Ti is a reinforcing element. Ti contributes to an increase in the strength of the steel sheet through strengthening by precipitates, fine-grain strengthening by the inhibition of the growth of ferrite crystal grains, and dislocation strengthening by the inhibition of recrystallization. When the Ti content is less than 0.001%, these effects are not obtained. Accordingly, a lower limit value is preferably set at 0.001% or more. Ti content may be 0.003% or more, 0.010% or more, or 0.050% or more. When the Ti content is more than 0.500%, the hydrogen embrittlement resistance may be deteriorated due to an increased precipitation of carbonitrides. Accordingly, an upper limit value is set at 0.500% or less. The Ti content may be 0.450% or less, 0.400% or less, or 0.300% or less.

(B: 0 to 0.0100%)

B is an element which inhibits the generation of ferrite and pearlite from austenite in a cooling process and facilitates the generation of a low-temperature transformed structure of bainite, martensite or the like. Further, B is an element beneficial for improving the steel strength, and it is added as required. When the B content is less than 0.0001%, the effect of improving the strength by the addition is not sufficiently obtained. Moreover, not only the most careful attention must be paid when performing an analysis to identify a B content of less than 0.0001%, but also such a B content may be below the detection limit depending on the analysis equipment. Accordingly, a lower limit value is preferably set at 0.0001% or more. The B content may be 0.0003% or more, 0.0005% or more, or 0.0010% or more. When the B content is more than 0.0100%, coarse B oxide may be generated in the steel, and the hydrogen embrittlement resistance may be deteriorated with the B oxide serving as the origin of void generation during cold working. Accordingly, an upper limit value is set at 0.0100% or less. The B content may be 0.0080% or less, 0.0060% or less, or 0.0050% or less.

(Nb: 0 to 0.500%)

Similarly to Ti, Nb is an element effective for controlling the form of carbides and, since an addition thereof leads to structural refinement, Nb is also an element effective for improving the toughness. When the Nb content is less than 0.001%, these effects are not obtained. Accordingly, a lower limit value is preferably set at 0.001% or more. The Nb content may be 0.002% or more, 0.010% or more, or 0.020% or more. When the Nb content is more than 0.500%, the generation of coarse Nb carbide is notably induced, and cracks are likely to be formed at the coarse Nb carbide; therefore, the hydrogen embrittlement resistance may be deteriorated. Accordingly, an upper limit value is set at 0.500% or less. The Nb content may be 0.450% or less, 0.400% or less, or 0.300% or less.

(V: 0 to 0.500%)

V is a reinforcing element. V contributes to an increase in the strength of the steel sheet through strengthening by precipitates, fine-grain strengthening by the inhibition of the growth of ferrite crystal grains, and dislocation strengthening by the inhibition of recrystallization. When the V content is less than 0.001%, these effects are not obtained. Accordingly, a lower limit value is preferably set at 0.001% or more. The V content may be 0.002% or more, 0.010% or more, or 0.020% or more. When the V content is more than 0.500%, the hydrogen embrittlement resistance may be deteriorated due to an increased precipitation of carbonitrides. Accordingly, an upper limit value is set at 0.500% or less. The V content may be 0.450% or less, 0.400% or less, or 0.300% or less.

(Cu: 0 to 0.500%)

Cu is an element effective for improving the strength of the steel sheet. When the Cu content is less than 0.001%, this effect is not obtained. Accordingly, a lower limit value is preferably set at 0.001% or more. The Cu content may be 0.002% or more, 0.010% or more, or 0.030% or more. When the Cu content is more than 0.500%, due to embrittlement of the steel material during hot rolling, it may be impossible to perform hot rolling, or the hydrogen embrittlement resistance may be deteriorated. Accordingly, an upper limit value is set at 0.500% or less. The Cu content may be 0.450% or less, 0.400% or less, or 0.300% or less.

(W: 0 to 0.100%)

W is an extremely important element not only because it is effective for improving the strength of the steel sheet, but also because W-containing precipitates and crystals act as hydrogen trapping sites. When the W content is less than 0.001%, these effects are not obtained. Accordingly, a lower limit value is preferably set at 0.001% or more. The W content may be 0.002% or more, 0.005% or more, or 0.010% or more. When the W content is more than 0.100%, the generation of coarse W precipitates or crystals is notably induced and, since cracks are likely to be formed at the coarse W precipitates or crystals and such cracks propagate in the steel material with a low load stress, the hydrogen embrittlement resistance may be deteriorated. Accordingly, an upper limit value is set at 0.100% or less. The W content may be 0.080% or less, 0.060% or less, or 0.050% or less.

(Ta: 0 to 0.100%)

Similarly to Nb, V and W, Ta is an element effective for controlling the form of carbides and improving the strength, and Ta is added as required. When the Ta content is less than 0.001%, the effects of the addition are not obtained. Accordingly, a lower limit value is preferably set at 0.001% or more. The Ta content may be 0.002% or more, 0.005% or more, or 0.010% or more. When the Ta content is more than 0.100%, fine Ta carbide is precipitated in a large amount, and this causes an increase in the strength and a reduction in the ductility of the steel sheet, as a result of which the bending resistance may be reduced or the hydrogen embrittlement resistance may be deteriorated. Accordingly, an upper limit value is set at 0.100% or less. The Ta content may be 0.080% or less, 0.060% or less, or 0.050% or less.

(Sn: 0 to 0.050%)

Sn is an element which is incorporated into steel when scrap is used as a raw material, and the lower the Sn content, the more preferred it is. An Sn content of less than 0.001%, however, leads to an increase in the refining cost. Accordingly, a lower limit value is preferably set at 0.001% or more. The Sn content may be 0.002% or more, 0.005% or more, or 0.010% or more. When the Sn content is more than 0.050%, the hydrogen embrittlement resistance may be deteriorated due to embrittlement of grain boundaries. Accordingly, an upper limit value is set at 0.050% or less. The Sn content may be 0.040% or less, 0.030% or less, or 0.020% or less.

(Sb: 0 to 0.050%)

Similarly to Sn, Sb is an element which is incorporated when scrap is used as a steel raw material. Sb is strongly segregated at grain boundaries and causes embrittlement of the grain boundaries and a reduction of the ductility; therefore, the lower the Sb content, the more preferred it is, and the Sb content may be 0%. An Sb content of less than 0.001%, however, leads to an increase in the refining cost. Accordingly, a lower limit value is preferably set at 0.001% or more. The Sb content may be 0.002% or more, 0.005% or more, or 0.008% or more. When the Sb content is more than 0.050%, the hydrogen embrittlement resistance may be deteriorated. Accordingly, an upper limit value is set at 0.050% or less. The Sb content may be 0.040% or less, 0.030% or less, or 0.020% or less.

(As: 0 to 0.050%)

Similarly to Sn and Sb, As is an element which is incorporated when scrap is used as a steel raw material, and is strongly segregated at grain boundaries. The lower the As content, the more preferred it is. An As content of less than 0.001%, however, leads to an increase in the refining cost. Accordingly, a lower limit value is preferably set at 0.001% or more. The As content may be 0.002% or more, 0.003% or more, or 0.005% or more. When the As content is more than 0.050%, the hydrogen embrittlement resistance may be deteriorated. Accordingly, an upper limit value is set at 0.050% or less. The As content may be 0.040% or less, 0.030% or less, or 0.020% or less.

(Mg: 0 to 0.0500%)

Mg is an element which can control the form of sulfides when added in a trace amount, and it is added as required. When the Mg content is less than 0.0001%, this effect is not obtained. Accordingly, a lower limit value is preferably set at 0.0001% or more. The Mg content may be 0.0005% or more, 0.0010% or more, or 0.0050% or more. When the Mg content is more than 0.0500%, the hydrogen embrittlement resistance may be deteriorated due to the formation of coarse inclusions. Accordingly, an upper limit value is set at 0.0500% or less. The Mg content may be 0.0400% or less, 0.0300% or less, or 0.0200% or less.

(Ca: 0 to 0.050%)

Ca is useful as a deoxidizing element and also exerts an effect in controlling the form of sulfides. When the Ca content is less than 0.001%, the effects of Ca are not sufficiently obtained. Accordingly, a lower limit value is preferably set at 0.001% or more. The Ca content may be 0.002% or more, 0.004% or more, or 0.006% or more. When the Ca content is more than 0.050%, the hydrogen embrittlement resistance may be deteriorated due to the formation of coarse inclusions. Accordingly, an upper limit value is set at 0.050% or less. The Ca content may be 0.040% or less, 0.030% or less, or 0.020% or less.

(Y: 0 to 0.050%)

Similarly to Mg and Ca, Y is an element which can control the form of sulfides when added in a trace amount, and it is added as required. When the Y content is less than 0.001%, this effect is not obtained. Accordingly, a lower limit value is preferably set at 0.001% or more. The Y content may be 0.002% or more, 0.004% or more, or 0.006% or more. When the Y content is more than 0.050%, the hydrogen embrittlement resistance may be deteriorated due to the formation of coarse Y oxide. Accordingly, an upper limit value is set at 0.050% or less. The Y content may be 0.040% or less, 0.030% or less, or 0.020% or less.

(Zr: 0 to 0.050%)

Similarly to Mg, Ca and Y, Zr is an element which can control the form of sulfides when added in a trace amount, and it is added as required. When the Zr content is less than 0.001%, this effect is not obtained. Accordingly, a lower limit value is preferably set at 0.001% or more. The Zr content may be 0.002% or more, 0.004% or more, or 0.006% or more. When the Zr content is more than 0.050%, the hydrogen embrittlement resistance may be deteriorated due to the formation of coarse Zr oxide. Accordingly, an upper limit value is set at 0.050% or less. The Zr content may be 0.040% or less, 0.030% or less, or 0.020% or less.

(La: 0 to 0.050%)

La is an element which is effective for controlling the form of sulfides when added in a trace amount, and it is added as required. When the La content is less than 0.001%, this effect is not obtained. Accordingly, a lower limit value is preferably set at 0.001% or more. The La content may be 0.002% or more, 0.004% or more, or 0.006% or more. When the La content is more than 0.050%, the hydrogen embrittlement resistance may be deteriorated due to the formation of La oxide. Accordingly, an upper limit value is set at 0.050% or less. The La content may be 0.040% or less, 0.030% or less, or 0.020% or less.

(Ce: 0 to 0.050%)

Similar to La, Ce is an element which can control the form of sulfides when added in a trace amount, and it is added as required. When the Ce content is less than 0.001%, this effect is not obtained. Accordingly, a lower limit value is preferably set at 0.001% or more. The Ce content may be 0.002% or more, 0.004% or more, or 0.006% or more. When the Ce content is more than 0.050%, the hydrogen embrittlement resistance may be deteriorated due to the formation of Ce oxide. Accordingly, an upper limit value is set at 0.050% or less. The Ce content may be 0.040% or less, 0.030% or less, or 0.020% or less.

In the steel sheet according to one embodiment of the present invention, the remainder other than the above-described components is composed of Fe and impurities. The term "impurities" used herein includes components which are incorporated due to various factors of the production process during the industrial production of a steel sheet, such as raw materials including ore, scrap and the like, and are not intentionally added to the steel sheet according to one embodiment of the present invention (so-called unavoidable impurities). The term "impurities" also includes elements other than the above-described components, which elements are contained in the steel sheet according to one embodiment of the present invention at a level that the actions and effects unique to the respective elements do not affect the properties of the steel sheet.

Next, the characteristic features of the structure and properties of the steel sheet according to one embodiment of the present invention will be described.

(Ferrite: 5.0% or Less)

The area ratio of ferrite affects the deformability of a steel containing martensite as a main structure, and the local deformability and the hydrogen embrittlement resistance are reduced as this area ratio increases. An area ratio of higher than 5.0% causes fracture in elastic deformation when a stress is applied, and this may lead to deterioration of the hydrogen embrittlement resistance. Accordingly, an upper limit value is set at 5.0% or lower, and the area ratio of ferrite may be 4.0% or lower, 3.0% or lower, or 2.0% or lower. The area ratio of ferrite may be 0%; however, an area ratio of lower than 1.0% requires an advanced control in the production, and this leads to a reduction in the yield; therefore, a lower limit value is preferably 1.0% or higher.

(Total of Martensite and Tempered Martensite: 90.0% or More)

The total area ratio of martensite and tempered martensite affects the steel strength, and the tensile strength is increased as the area ratio increases. At lower than 90.0%, the area ratio of martensite and tempered martensite is not sufficient, and not only a target tensile strength cannot be achieved, but also fracture may occur during elastic deformation under a stress, and the hydrogen embrittlement resistance may be deteriorated. Accordingly, a lower limit value is set at 90.0% or higher. The total area ratio of martensite and tempered martensite may be 95.0% or higher, 97.0% or higher, 99.0% or higher, or 100.0%.

(Balance Structure (Remaining Structure))

The area ratio of a balance structure other than the above-described structures may be 0%; however, when there is a balance structure, it is composed of at least one of bainite, pearlite, and retained austenite. Pearlite and retained austenite are structural factors that deteriorate the local ductility of steel; therefore, the lower the content thereof, the more preferred it is. When the area ratio of the balance structure is higher than 8.0%, fracture occurs during elastic deformation under a stress, and the hydrogen embrittlement resistance may be deteriorated. Accordingly, although the area ratio of the balance structure is not particularly restricted, it is preferably 8.0% or lower, more preferably 7.0% or lower. Meanwhile, in order to attain a balance structure area ratio of 0%, an advanced control is required in the production, and this may lead to a reduction in the yield. Accordingly, a lower limit value may be 1.0% or higher.

(Standard Deviation a of Mn Concentration $\geq 0.15\ Mn_{ave}$)

The standard deviation a of the Mn concentration is an index that represents the distribution of the Mn concentration in a steel material, and a larger value corresponds to the presence of a region having a higher concentration than the average Mn concentration ($Mn_{ave}$) Since microvoids are formed in such a Mn-concentrated region, the hydrogen embrittlement resistance is improved. When the standard deviation a is smaller than 0.15 $Mn_{ave}$, the effect of improving the hydrogen embrittlement resistance by the formation of microvoids cannot be obtained due to insufficient area of the Mn-concentrated region. Accordingly, a lower limit value is set at 0.15 $Mn_{ave}$ or larger, and the standard deviation a may be 0.17 $Mn_{ave}$ or larger, or 0.20 $Mn_{ave}$ or larger. The higher the area ratio of Mn-concentrated parts, the more preferred it is; however, when the standard deviation is excessively large, the hydrogen embrittlement resistance may be deteriorated since joining of the Mn-concentrated parts is facilitated due to an increase in the area ratio of the Mn-concentrated parts. Accordingly, the standard deviation a of the Mn concentration is preferably 1.00 $Mn_{ave}$ or smaller, and may be 0.90 $Mn_{ave}$ or smaller, or 0.80 $Mn_{ave}$ or smaller.

(Circle-Equivalent Diameter of Region with Mn Concentration of Higher than ($Mn_{ave}+1.3\sigma$): Less than 10.0 μn)

The circle-equivalent diameter of a region with a Mn concentration of higher than ($Mn_{ave}+1.3a$) is a factor that controls the size of microvoids that are formed in Mn-concentrated parts. The hydrogen embrittlement resistance is improved as a greater number of microvoids are more finely dispersed in steel. The smaller the size of a Mn-concentrated region, the more preferred it is; however, when the Mn-concentrated region is small, the formation of microvoids therein is inhibited, as a result of which the effects of the present invention may not be obtained. Accordingly, the circle-equivalent diameter is preferably 1.0 μm or larger. When the circle-equivalent diameter is 10.0 μm or larger, cracks generated in the Mn-concentrated region of this size have a large length, and the stress concentration at crack ends is increased; therefore, such large cracks may propagate in steel and thereby cause fracture of the steel material before the effect of improving the hydrogen embrittlement resistance can be obtained. Accordingly, an upper limit value is set at less than 10 μm, and the circle-equivalent diameter may be 9.0 μm or less, or 8.0 μm or less.

Next, method of observing and measuring the above-prescribed structures will be described.

(Method of Evaluating Area Ratio of Ferrite)

The area ratio of ferrite is determined by observing a portion in a range of ⅛ to ⅜ of the sheet thickness that is centered at the ¼-thickness position on an electron channeling contrast image under a field emission-scanning electron microscope (FE-SEM). Electron channeling contrast imaging is a technique for detecting misorientation in crystal grains as a difference in contrast and, on the thus obtained image, polygonal ferrite is observed as a part having a uniform contrast within a structure judged as ferrite, not pearlite, bainite, martensite or retained austenite. The area ratio of polygonal ferrite is determined by an image analysis method for each of eight viewing fields on a 35 μm×25 μm electron channeling contrast image, and an average value thereof is defined as the area ratio of ferrite.

(Method of Evaluating Total Area Ratio of Martensite and Tempered Martensite)

The total area ratio of martensite and tempered martensite is also determined from the above-described image taken by electron channeling contrast imaging. The structures of martensite and tempered martensite are less likely to be etched than ferrite and thus exist as protrusions on the structure observation surface. It is noted here that tempered martensite is a collection of lath-like crystal grains, inside of which iron-based carbides with a major axis of 20 nm or longer are contained and the carbides belong to plural variants, i.e. plural groups of iron-based carbides extending in different directions. Further, retained austenite also exists as protrusions on the structure observation surface. Therefore, the total area ratio of martensite and tempered martensite can be accurately measured by subtracting the area ratio of retained austenite that is determined by the below-described procedures from the area ratio of the protrusions that is determined by the above-described procedures.

(Method of Evaluating Total Area Ratio of Bainite, Pearlite, and Retained Austenite)

The area ratio of retained austenite can be determined by a measurement using an X-ray. In other words, a portion of a sample from a sheet surface to the ¼-depth position in the sheet thickness direction is removed by mechanical polishing and chemical polishing. Subsequently, the fraction of retained austenite structure is calculated from the integrated intensity ratios of the (200) and (211) diffraction peaks of the bcc phase and the (200), (220) and (311) diffraction peaks of the fcc phase, which are obtained by using MoKα radiation as a characteristic X-ray on the polished sample, and the thus calculated value is defined as the area ratio of retained austenite. Further, the area ratio of pearlite is determined from an image taken by the above-described electron channeling contrast imaging. Pearlite is a structure in which plate-like carbide and ferrite are layered. Bainite is a collection of lath-like crystal grains inside of which iron-based carbides with a major axis of 20 nm or longer are not contained, or inside of which iron-based carbides with a major axis of 20 nm or longer are contained and the carbides belong to a single variant, i.e. a group of iron-based carbides extending in the direction. The phrase "group of iron-based carbides extending in the same direction" used herein refers to a group of iron-based carbides in which a difference in the extension direction is within 5°. Bainite surrounded by grain boundaries having an orientation difference of 15° or larger is counted as a single bainite grain.

(Method of Evaluating Standard Deviation a of Mn Concentration)

The concentration distribution of Mn is measured using an EPMA (electron probe microanalyzer). In the same manner as in the above-described structural observation by SEM, an element concentration map is obtained at measurement intervals of 0.1 μm for a 35 μm×25 μm region in a range of ⅛ to ⅜ of the sheet thickness that is centered at the ¼-thickness position. A histogram of the Mn concentration is determined based on the data of element concentration maps obtained for eight viewing fields, and the histogram of the Mn concentration thus obtained in this experiment is approximated by normal distribution to calculate the standard deviation a. In the preparation of the histogram, the interval of the Mn concentration is set at 0.1%. Further, a median value obtained by the approximation of the histogram of the Mn concentration based on normal distribution is defined as the "average Mn concentration ($Mn_{ave}$)" in the present invention.

(Method of Evaluating Circle-Equivalent Diameter of Region with Mn Concentration of Higher Than ($Mn_{ave}$+1.3σ))

The circle-equivalent diameter of a region having a Mn concentration of ($Mn_{ave}$+1.3σ) is measured based on the Mn concentration maps obtained for eight viewing fields by the above-described procedures. In the measurement of the circle-equivalent diameter, a binarized images in which a region with a Mn concentration of ($Mn_{ave}$+1.3σ) or lower and a region with a Mn concentration of higher than ($Mn_{ave}$+1.3σ) are color-coded is prepared, the area of each concentrated part is determined by image analysis, and the diameter of a circle corresponding to the thus determined area is calculated. The area of a Mn-concentrated part that is determined in this procedure is merely an area value at a two-dimensional cross-section and, in reality, Mn-concentrated parts exist three-dimensionally. In order to determine the three-dimensional region of such Mn-concentrated parts, the diameters of circles corresponding to the above-determined areas of individual Mn-concentrated parts are approximated by logarithmic normal distribution, and a median value in this logarithmic normal distribution is defined as the circle-equivalent diameter. In this determination of the logarithmic normal distribution, the Mn concentration is set at the following classes: 0.10 μm, 0.16 μm, 0.25 μm, 0.40 μm, 0.63 μm, 1.00 μm, 1.58 μm, 2.51 μm, 3.98 μm, 6.31 μm, 10.00 μm, 15.85 μm, 25.12 μm, 39.81 μm, 63.10 μm, and 100.00 μm. The reason for setting 0.10 μm as the lower limit value of the Mn concentration class is because the circle-equivalent diameter per analysis point (0.01 $\mu m^2$) is 0.11 μm when the measurement interval in the analysis of the Mn concentration by EPMA is set at 0.1 μm.

(Plated Layer)

The steel sheet according to one embodiment of the present invention may have a plated layer containing an element such as zinc on at least one surface, preferably on both surfaces of the steel sheet. This plated layer may have any composition known to those of ordinary skill in the art and is not particularly restricted. For example, the plated layer may contain additive elements such as aluminum and magnesium, in addition to zinc. Further, an alloying treatment may or may not be performed on this plated layer. When an alloying treatment is performed, the resulting plated layer may contain an alloy of at least one of the above-described elements with iron diffused out of the steel sheet. The amount of the plated layer to be adhered is not particularly restricted, and may be any ordinary amount.

(Mechanical Properties)

According to the steel sheet of one embodiment of the present invention, the hydrogen embrittlement resistance can be improved while achieving a high tensile strength, specifically a tensile strength of 1,300 MPa or higher, as well as a high ductility, specifically a total elongation of 5.0% or more. The tensile strength is preferably 1,350 MPa or higher, more preferably 1,400 MPa or higher.

<Method of Producing Steel Sheet>

A method of producing the steel sheet according to one embodiment of the present invention is characterized by coherent management of the hot rolling, cold rolling and annealing conditions with the use of materials in the above-described component ranges. One example of a method of producing a steel sheet will now be described; however, a method of producing the steel sheet according to the present invention is not restricted to the below-described mode.

The method of producing the steel sheet according to one embodiment of the present invention is characterized by including:

- a hot rolling step, which includes finish rolling a steel piece (slab) having the same chemical composition as that described above for the steel sheet and satisfies the following conditions:
  - finish-rolling start temperature is 950 to 1,150° C.,
  - the finish rolling is performed in three or more passes at a rolling reduction ratio of 20% or higher,
  - in the finish rolling, the pass interval between each rolling pass giving a rolling reduction ratio of 20% or higher and its immediate preceding rolling pass is 0.2 to 5.0 seconds,
  - a finish-rolling termination temperature is 650 to 950° C.,
  - cooling is started within a range of 1.0 to 5.0 seconds after the termination of the finish-rolling, and
  - the cooling is performed at an average cooling rate of 20.0 to 50.0° C./sec;
- a step of coiling the thus obtained hot-rolled steel sheet at a coiling temperature of 450 to 700° C.; and
- a step of cold rolling the hot-rolled steel sheet and subsequently annealing the steel sheet at a temperature of 800 to 900° C.

These steps will now each be described in detail.

(Hot Rolling Step)

In the hot rolling step, hot rolling is performed on a steel piece having the same chemical composition as that described above for the steel sheet. From the standpoint of the productivity, the steel piece to be used is preferably produced by a continuous casting method; however, the steel piece may be produced by an ingot casting method or a thin slab casting method.

(Rough Rolling)

In the present method, for example, rough rolling may be optionally performed on the cast steel piece before finish-rolling so as to adjust the resulting sheet thickness and the like. The conditions of this rough rolling are not particularly restricted as long as the desired sheet bar dimensions can be ensured.

(Finish-Rolling Start Temperature: 950 to 1,150° C.)

Subsequently, finish rolling is performed on the thus obtained steel piece, or the steel piece that has been additionally rough rolled as required. The finish-rolling start temperature is an important factor for controlling the recrystallization of austenite. When the finish-rolling start temperature is lower than 950° C., a reduction in temperature after the finish rolling causes non-recrystallized austenite to remain and, in the cooling process performed after the finish hot rolling, ferrite is generated from the grain boundaries of austenite and the inside of elongated austenite grains is entirely transformed into pearlite; therefore, when Mn is concentrated to the cementite lamellae of pearlite, a region of the resulting concentrated parts has a circle-equivalent diameter of larger than 10.0 μm. Accordingly, a lower limit value is set at 950° C. or higher, and the finish-rolling start temperature may be 970° C. or higher, or 980° C. or higher. Further, when the finish-rolling start temperature is higher than 1,150° C., due to a high temperature during the finish rolling, alloy elements such as C, Si, Mn, P, S, and B are segregated to the grain boundaries of recrystallized austenite, as a result of which ferrite transformation in the cooling process performed after the finish rolling is inhibited. Accordingly, an upper limit value is set at 1,150° C. or lower, and the finish-rolling start temperature may be 1,140° C. or lower, or 1,130° C. or lower.

(Finish Rolling in Three or More Passes at Rolling Reduction Ratio of 20% or Higher)

The number of rolling operations performed at a rolling reduction ratio of 20% or higher in the finish rolling has an effect of facilitating the recrystallization of austenite during the rolling, and the form of austenite grains can be controlled to be equiaxial and fine by controlling the rolling reduction ratio, the number of rolling operations, and the pass interval in the finish rolling. With less than three passes, non-recrystallized austenite remains; therefore, the effects of the present invention cannot be obtained. Accordingly, a lower limit value is set at three passes or more, and the finish rolling may be performed in four or more passes, or five or more passes. Meanwhile, an upper limit value is not particularly restricted; however, a large number of rolling strands need to be installed for performing more than 10 passes, and this may lead to an increase in the equipment size and the production cost. Accordingly, an upper limit value is preferably set at 10 passes or less, and the finish rolling may be performed in 9 passes or less, or 7 passes or less.

(Pass Interval Between Each Rolling Pass Giving Rolling Reduction Ratio of 20% or Higher and its Preceding Rolling Pass in Finish Rolling: 0.2 to 5.0 Seconds)

The pass interval of the rolling operations performed at a reduction ratio of 20% or higher in the finish rolling is a factor that controls the post-rolling recrystallization and growth of austenite grains. When the pass interval is shorter than 0.2 seconds, austenite is not completely recrystallized, and the ratio of non-recrystallized austenite is thus increased; therefore, the effects of the present invention cannot be obtained. Accordingly, a lower limit value is set at 0.2 seconds or longer, and the pass interval may be 0.3 seconds or longer, or 0.5 seconds or longer. Further, when the pass interval is longer than 5.0 seconds, alloy elements such as C, Si, Mn, P, S, and B are segregated toward the grain boundaries of recrystallized austenite, as a result of which ferrite transformation in the cooling process performed after the finish rolling is inhibited. Accordingly, an upper limit value is set at 5.0 seconds or shorter, and the pass interval may be 4.5 seconds or shorter, or 4.0 seconds or shorter.

(Finish-Rolling Termination Temperature: 650 to 950° C.)

The finish-rolling termination temperature is an important factor for controlling the recrystallization of austenite. When the finish-rolling termination temperature is lower than 650° C., non-recrystallized austenite is allowed to remain; therefore, the effects of the present invention cannot be obtained. Accordingly, a lower limit value is set at 650° C. or higher, and the finish-rolling termination temperature may be 670° C. or higher, or 700° C. or higher. Further, when the finish-rolling termination temperature is higher than 950° C., alloy elements such as C, Si, Mn, P, S, and B are segregated to the grain boundaries of recrystallized austenite, as a result of which ferrite transformation in the cooling process performed after the finish rolling is inhibited. Accordingly, an upper limit value is set at 950° C. or lower, and the finish-rolling termination temperature may be 930° C. or lower, or 900° C. or lower.

(Start of Cooling within Range of 1.0 to 5.0 Seconds after Termination of Finish Rolling)

The time until the start of cooling after the termination of the finish rolling is an important factor for controlling the recrystallization behavior of austenite and the segregation of alloy elements to the austenite grain boundaries. When the time until the start of cooling is shorter than 1.0 second, austenite is not completely recrystallized, and this causes non-recrystallized austenite to remain; therefore, the effects of the present invention cannot be obtained. Accordingly, a lower limit value is set at 1.0 second or longer, and it may be 2.0 seconds or longer. Further, when the time until the start of cooling is longer than 5.0 seconds, alloy elements such as C, Si, Mn, P, S, and B are segregated to the grain boundaries of recrystallized austenite, as a result of which ferrite transformation in the cooling process performed after the finish rolling is inhibited. Accordingly, an upper limit value is set at 5.0 seconds or shorter, and it may be 4.0 seconds or shorter.

(Average Cooling Rate: 20.0 to 50.0° C./sec)

After the start of cooling, the average cooling rate from the finish-rolling termination temperature to a temperature of 100° C. lower than the finish-rolling termination temperature is an important factor for controlling ferrite transformation and pearlite transformation from austenite. When the average cooling rate is lower than 20.0° C./sec, alloy elements are segregated to the austenite grain boundaries in the middle of the cooling, and this leads to the presence of austenite grain boundaries not generating ferrite transformation; therefore, pearlite structure is coarsened, and the grain size of Mn-concentrated parts is increased. Accordingly, a lower limit value is set at 20.0° C./sec or higher, and the average cooling rate may be 25.0° C./sec or higher, or 30.0° C./sec or higher. Further, when the average cooling rate is higher than 50.0° C./sec, pearlite transformation following the ferrite transformation is unlikely to occur, as a result of which concentration of Mn to the cementite lamellae of pearlite cannot be facilitated. Accordingly, an upper limit value is set at 50.0° C./sec or lower, and the average cooling rate may be 45.0° C./sec or lower, or 40.0° C./sec. After the finish rolling, for example, by arranging a region where cooling water is not applied to the hot-rolled steel sheet in the middle of the cooling thereof and thereby maintaining the temperature of the hot-rolled steel sheet at a prescribed temperature (intermediate retention), the ferrite transformation from the austenite grain boundaries can be facilitated, and the resulting ferrite structures can be brought into contact with one another as the nucleation of ferrite grains is increased, whereby the amount of the above-described austenite grain boundaries not generating ferrite transformation can be reduced. It is believed that, as a result, coarsening of pearlite structure can be inhibited, so that the steel sheet according to the present invention can be produced in a more stable manner.

(Coiling Step)

After the hot rolling step, the thus obtained hot-rolled steel sheet is coiled at a coiling temperature of 450 to 700° C. in the subsequent coiling step. The coiling temperature is an important factor for controlling the steel structure of the hot-rolled sheet. When the coiling temperature is lower than 450° C., pearlite transformation does not occur, making it difficult to facilitate concentration of Mn to cementite. Accordingly, a lower limit value is set at 450° C. or higher, and the coiling temperature may be 470° C. or higher, or 490° C. or higher. Further, when the coiling temperature is higher than 700° C., oxygen is supplied from the steel strip surface into the steel sheet, and an internal oxide layer is formed in the surface layer of the hot-rolled sheet. The term "internal oxide" refers to an oxide formed along the crystal grain boundaries of steel and, if such an oxide remains after cold rolling and annealing, it serves as the origin of cracks to cause a reduction in the hydrogen embrittlement resistance. Accordingly, an upper limit value is set at 700° C., and the coiling temperature may be 690° C. or lower, or 670° C. or lower. In the coiling step, for example, by arranging a region where cooling water (e.g., cooling water for cooling a support roll that inhibits meandering of the hot-rolled steel sheet during threading, or a mandrel roll used for winding the hot-rolled steel sheet into a coil shape) is not applied to the hot-rolled steel sheet and thereby inhibiting uneven cooling of the hot-rolled steel sheet at the time of coiling thereof, the temperature inside the coil is made uniform to maintain the hot-rolled steel sheet at a prescribed temperature, whereby ferrite structure is allowed to grow at the austenite grain boundaries, and the amount of the above-described austenite grain boundaries not generating ferrite transformation can be reduced. It is believed that, as a result, joining and coarsening of pearlite structure can be inhibited, so that the steel sheet according to the present invention can be produced in a more stable manner.

(Cold Rolling and Annealing Step)

Lastly, the thus obtained hot-rolled steel sheet is, for example, pickled as required, and subsequently cold rolled and then annealed at 800 to 900° C., whereby the steel sheet according to one embodiment of the present invention is obtained. Preferred embodiments of cold rolling, annealing and plating treatment are described below in detail. The descriptions below are, however, merely examples of preferred embodiments of cold rolling, annealing and plating treatment, and should not restrict a method of producing the steel sheet by any means.

(Pickling)

First, prior to the cold rolling, the coiled hot-rolled steel sheet is uncoiled and pickled. By performing this pickling, oxide scales on the surface of the hot-rolled steel sheet can be removed to improve the chemical conversion and plating properties of the resulting cold-rolled steel sheet. The pickling may be performed once or plural separate times.

(Cold-Rolling Reduction Ratio)

The cold-rolling reduction ratio is a factor that affects the growth of carbide grains in the heating process of the cold rolling and annealing as well as the dissolution behavior of carbides at the time of soaking. When the cold-rolling reduction ratio is lower than 10.0%, an effect of fracturing carbides is not obtained, and this may cause undissolved carbides to remain at the time of soaking. Accordingly, a lower limit value is preferably set at 10.0% or higher, and the cold-rolling reduction ratio may be 15.0% or higher. Further, when the cold-rolling reduction ratio is higher than 80.0%, the dislocation density in the steel is increased, and carbide grains grow in the heating process of the cold rolling and annealing. As a result, carbides that are difficult to dissolve remain at the time of soaking, and this may lead to a reduction in the strength of the steel sheet. Accordingly, an upper limit value is preferably set at 80.0% or lower, and the cold-rolling reduction ratio may be 70.0% or lower.

(Cold-Rolled Sheet Annealing)

(Heating Rate)

When the cold-rolled steel sheet is passed through a continuous annealing line or a plating line, the heating rate is not particularly restricted; however, since the productivity may be largely deteriorated at a heating rate of lower than 0.5° C./sec, the heating rate is preferably 0.5° C./sec or higher. On the other hand, a heating rate of higher than 100° C./sec involves an excessively large equipment investment; therefore, the heating rate is preferably 100° C./sec or lower.

(Annealing Temperature)

The annealing temperature is an important factor for controlling austenization of steel and microsegregation of Mn. Carbides on which Mn is concentrated may remain undissolved during retention in the annealing. Since undissolved carbides cause deterioration of the steel properties, the lower the volume ratio of undissolved carbides, the more preferred it is. Meanwhile, undissolved carbides may still remain only with a treatment of retaining the steel sheet at a high temperature for an extended period; therefore, in order to facilitate the dissolution of such carbides, the steel sheet may be repeatedly processed twice or more by a treatment in which the steel sheet is heated from room temperature to the annealing temperature, subsequently once cooled to room temperature, and then heated again to the annealing temperature. When the annealing temperature is lower than 800° C., the amount of generated austenite is small, and such an annealing temperature causes undissolved carbides to remain, causing a reduction in strength. Accordingly, a lower limit value is set at 800° C. or higher, and the annealing temperature may be 830° C. or higher. Further, when the annealing temperature is higher than 900° C., since the Mn-concentrated parts formed in the hot-rolled sheet are dispersed during high-temperature soaking, the effects of the present invention cannot be obtained. Accordingly, an upper limit value is set at 900° C. or lower, and the annealing temperature may be 870° C. or lower.

(Retention Time)

The steel sheet is supplied to a continuous annealing line to perform annealing with heating at the annealing temperature. In this process, the retention time is preferably 10 to 600 seconds. When the retention time is shorter than 10 seconds, the fraction of austenite at the annealing temperature is insufficient and/or the carbides existing prior to the annealing are not sufficiently dissolved, as a result of which prescribed structure and properties may not be obtained. A retention time of longer than 600 seconds presents no problem in terms of properties; however, since it requires a long equipment line, an upper limit is substantially about 600 seconds.

(Cooling Rate)

After the above-described annealing, cooling is preferably performed from 750° C. to 550° C. at an average cooling rate of 100.0° C./sec or lower. A lower limit value of the average cooling rate is not particularly restricted and may be, for example, 2.5° C./sec. The reason for setting the lower limit value of the average cooling rate at 2.5° C./sec is to inhibit the occurrence of ferrite transformation in the base steel sheet and thereby prevent the base steel sheet from being softened. When the average cooling rate is lower than 2.5° C./sec, the strength may be reduced. The average cooling rate is more preferably 5.0° C./sec or higher, still more preferably 10.0° C./sec or higher, yet still more preferably 20.0° C./sec or higher. At a temperature of higher than 750° C., the cooling rate is not restricted since ferrite transformation is unlikely to occur. At a temperature of lower than 550° C., the cooling rate is also not restricted since a low-temperature transformed structure is obtained. When the cooling is performed at a rate of higher than 100.0° C./sec, a low-temperature transformed structure is generated in the surface layer as well, and this causes a variation in hardness; therefore, the cooling is performed at a rate of preferably 100.0° C./sec or lower, more preferably 80.0° C./sec or lower, still more preferably 60.0° C./sec or lower.

(Cooling Stop Temperature)

The above-described cooling is stopped at a temperature of 25° C. to 550° C. (cooling stop temperature). Subsequently, when this cooling stop temperature is lower than (plating bath temperature−40° C.), the steel sheet may be reheated and retained in a temperature range of 350° C. to 550° C. When the cooling is performed in the above-described temperature range, martensite is generated from untransformed austenite during the cooling. By reheating the steel sheet thereafter, martensite is tempered, and precipitation of carbides as well as recovery and rearrangement of dislocations take place in the hard phase, as a result of which the hydrogen embrittlement resistance is improved. The reason why the lower limit of the cooling stop temperature is set at 25° C. is not only because excessive cooling requires a significant equipment investment, but also because the effects of the cooling are saturated.

(Retention Temperature)

After the reheating or after the cooling, the steel sheet may be retained in a temperature range of 200 to 550° C. The retention in this temperature range not only contributes to tempering of martensite, but also eliminates temperature variation of the sheet in the width direction. In addition, when the steel sheet is subsequently immersed in a plating bath, the retention improves the post-plating outer appearance. It is noted here that, when the cooling stop temperature is the same as the retention temperature, the steel sheet may be retained as is without reheating or cooling.

(Retention Time)

The duration of the retention is desirably set at 10 seconds to 600 seconds so as to obtain the effects of the retention.

(Tempering Temperature)

In a series of annealing operations, the cold-rolled sheet, or the cold-rolled sheet on which a plating treatment has been performed, may be reheated after being cooled to room temperature, or may be reheated after being retained in the middle of being cooled to room temperature or after being cooled to a temperature of not higher than the temperature of subsequent retention, and then retained in a temperature range of 150° C. to 400° C. for 2 seconds or longer. According to this step, by tempering martensite generated during the post-reheating cooling into tempered martensite, the hydrogen embrittlement resistance can be improved. In addition, a steel ductility-improving effect is obtained by stabilization of retained austenite. When the tempering step is performed, with a retention temperature of lower than 150° C., martensite is not sufficiently tempered, and satisfactory changes thus may not be attained in terms of microstructure and mechanical properties. On the other hand, a retention temperature of higher than 400° C. causes a reduction of the dislocation density in tempered martensite, as a result of which the tensile strength may be deteriorated. Therefore, when tempering is performed, it is preferred to retain the steel sheet in a temperature range of 150° C. to 400° C.

(Tempering Time)

Further, when the retention time for tempering is shorter than 2 seconds, martensite is not sufficiently tempered, and satisfactory changes thus may not be attained in terms of microstructure and mechanical properties. The longer the tempering time, the smaller are the temperature difference and the material variation within the steel sheet. Accordingly, the longer the tempering time, the more preferred it is; however, a retention time of longer than 36,000 seconds leads to a reduction in the productivity. Therefore, a preferred upper limit of the retention time is 36,000 seconds or shorter. The tempering may be performed inside a continuous annealing equipment, or may be performed using a separate off-line equipment after the continuous annealing.

(Plating)

During or after the annealing step, as required, hot-dip galvanization may be performed on the cold-rolled steel sheet by heating or cooling the cold-rolled steel sheet to a temperature of (galvanizing bath temperature −40°) C. to (galvanizing bath temperature +50°) C. By this hot-dip galvanization step, a hot-dip galvanized layer is formed on at least one surface, preferably both surfaces of the cold-rolled steel sheet. In this case, the corrosion resistance of the cold-rolled steel sheet is improved, which is preferred. Even when hot-dip galvanization is performed, the hydrogen embrittlement resistance of the cold-rolled steel sheet can be maintained sufficiently.

For a plating treatment, for example, the Sendzimir method in which "after degreasing and pickling, a steel sheet is heated in a non-oxidizing atmosphere, annealed in a reducing atmosphere containing $H_2$ and $N_2$, subsequently cooled to the vicinity of the temperature of a plating bath, and then immersed in the plating bath", a total reduction furnace method in which "after the atmosphere during annealing is adjusted and a steel sheet surface is oxidized first, the steel sheet surface is reduced and thereby cleaned before being plated, and subsequently immersed in a plating bath", or a flux method in which "after degreasing and pickling of a steel sheet, the steel sheet is flux-treated with ammonium chloride and subsequently immersed in a plating bath" may be employed, and the effects of the present invention can be exerted under any of these treatment conditions.

(Plating Bath Temperature)

The plating bath temperature is preferably 450 to 490° C. When the plating bath temperature is lower than 450° C., the viscosity of the plating bath is excessively increased and this makes it difficult to control the thickness of the plated layer, as a result of which the outer appearance of the resulting hot-dip galvanized steel sheet may be deteriorated. On the other hand, when the plating bath temperature is higher than 490° C., a large amount of fume is generated, and this can make it difficult to safely perform the plating operations. The plating bath temperature is more preferably 455° C. or higher, but it is more preferably 480° C. or lower.

(Composition of Plating Bath)

As for the composition of the plating bath, the plating bath is preferably mainly composed of Zn and has an effective Al amount (a value obtained by subtracting a total Fe content from a total Al content in the plating bath) of 0.050 to 0.250% by mass. When the effective Al amount in the plating bath is less than 0.050% by mass, the plating adhesion may be deteriorated due to excessive diffusion of Fe into the plated layer. On the other hand, when the effective Al amount in the plating bath is greater than 0.250% by mass, Al-based oxides that inhibit the movement of Fe atoms and Zn atoms are generated at the interface between the steel sheet and the plated layer, as a result of which the plating adhesion may be deteriorated. The effective Al amount in the plating bath is more preferably 0.065% by mass or greater, but it is more preferably 0.180% by mass or less. The plating bath may also contain additive elements such as Mg, in addition to Zn and Al.

(Steel Sheet Temperature at Immersion in Plating Bath)

The plating bath immersion sheet temperature (the temperature of the steel sheet at the time of being immersed in a hot-dip galvanizing bath) is preferably in a range of 40° C. lower than the hot-dip galvanizing bath temperature ("hot-dip galvanizing bath temperature−40° C.") to 50° C. higher than the hot-dip galvanizing bath temperature ("hot-dip galvanizing bath temperature+50° C."). A plating bath immersion sheet temperature of lower than [hot-dip galvanizing bath temperature−40° C.] is not desirable since this may lead to deterioration of the plated outer appearance due to a large heat loss during the immersion in the plating bath and partial solidification of molten zinc. When the sheet temperature prior to the immersion is lower than [hot-dip galvanizing bath temperature−40° C.], the steel sheet may be further heated prior to the immersion in the plating bath by an arbitrary method so as to control the sheet temperature to be [hot-dip galvanizing bath temperature−40° C.] or higher, and the steel sheet may be immersed into the plating bath thereafter. Further, when the plating bath immersion sheet temperature is higher than [hot-dip galvanizing bath temperature+50° C.], an operational problem is induced in association with an increase in the plating bath temperature.

(Plating Pretreatment)

In order to further improve the plating adhesion, prior to the annealing in a continuous hot-dip galvanization line, the base steel sheet may be plated with one or more of Ni, Cu, Co, and Fe.

(Plating Post-treatment)

On the surface of the hot-dip galvanized steel sheet or alloyed hot-dip galvanized steel sheet, upper-layer plating and various treatments, such as a chromate treatment, a phosphate treatment, a lubricity improvement treatment and a weldability improvement treatment, may also be performed for the purpose of improving the coating properties and the weldability.

(Skin Pass Rolling)

In addition, skin pass rolling may be performed for the purpose of improving the ductility through correction of the steel sheet shape and introduction of mobile dislocations. In the skin pass rolling after the heat treatment, the rolling reduction ratio is preferably in a range of 0.1 to 1.5%. A lower limit thereof is set at 0.1% since a rolling reduction ratio of lower than 0.1% has a small effect and is difficult to control. The productivity is markedly deteriorated when the rolling reduction ratio is higher than 1.5%; therefore, an upper limit thereof is set at 1.5%. The skin pass may be performed in-line or off-line. Further, the skin pass of the target rolling reduction ratio may be performed at once, or may be performed in several separate operations.

The steel sheet according to the present invention can be obtained by the above-described production method.

EXAMPLES

Examples of the present invention will now be described; however, the present invention is not restricted to the conditions of the below-described Examples. The present invention can adopt a variety of conditions without departing from the gist of the present invention, as long as the object of the present invention is achieved.

Example 1

Steels having the respective chemical compositions shown in Table 1 were each melted and cast to produce a steel piece, and the thus obtained steel piece was inserted to a furnace heated to 1,220° C. and retained therein for 60 minutes to perform a homogenization treatment, after which the steel piece was taken out to the atmosphere and then hot-rolled to obtain a steel sheet having a thickness of 2.8 mm. In this hot rolling, finish rolling was performed a total of seven times, in three of which a rolling pass with a rolling reduction ratio of higher than 20% was applied. Further, in the finish rolling, the pass interval between each rolling pass giving a rolling reduction ratio of 20% or higher and its immediate preceding rolling pass was set at 0.6 seconds. The finish-rolling start temperature was 1,070° C. and the finish-rolling termination temperature was 890° C. After a lapse of 2.2 seconds from the termination of the finish rolling, the steel sheet was water-cooled to 580° C. at an average cooling rate of 35.0° C./sec (it is noted here that, after the start of cooling, the average cooling rate from the finish-rolling termination temperature (890° C.) to a temperature of 100° C. lower than the finish-rolling termination temperature (790° C.) was also 35.0° C./sec), and then coiled. Subsequently, oxide scales on the thus obtained hot-rolled steel sheet were removed by pickling, and the hot-rolled steel sheet was cold-rolled at a rolling reduction ratio of 50.0% to attain a thickness of 1.4 mm. Further, this cold-rolled steel sheet was heated to 890° C. at a rate of 12.0° C./sec and retained at 890° C. for 120 seconds, after which the steel sheet was cooled to 190° C. at an average cooling rate of 42.0° C./sec, and subsequently reheated to 230° C. and retained for 180 seconds to perform cold-rolled sheet annealing. In this cold-rolled sheet annealing, a plating treatment was not performed, and a post-heat treatment in which the steel sheet cooled to 150° C. was reheated to 200° C. and retained for 20 seconds was performed in the cooling process from 230° C. to room temperature. Table 2 shows the results of evaluating the properties of each steel sheet on which the above-described thermo-mechanical treatments were performed. It is noted here that the remainder other than the components shown in Table 1 was composed of Fe and impurities. The chemical composition analyzed for a sample collected from each of the thus produced steel sheets was the same as the chemical composition of the corresponding steel shown in Table 1.

(Method of Evaluating Tensile Properties)

The tensile strength (TS) and the total elongation (El) were measured by performing a tensile test in accordance with JIS Z2241(2011) for a JIS No. 5 test piece that was collected such that the longitudinal direction of the test piece was aligned parallel to the direction perpendicular to the rolling direction of a steel strip.

(Method of Evaluating Hydrogen Embrittlement Resistance)

For each hot-dip galvanized steel sheet produced by the method of producing the steel sheet according to one embodiment of the present invention, the hydrogen embrittlement resistance was evaluated in accordance with the method described in Materia Japan (Bulletin of the Japan Institute of Metals), Vol. 44, No. 3 (2005) pp. 254 to 256. Specifically, after the steel sheet was sheared at a clearance of 10%, a U-bending test was conducted at 10R. A strain gauge was attached to the center of the thus obtained test piece, and both ends of this test piece were fastened with bolts to apply a stress to the test piece. The applied stress was calculated from the strain indicated on the monitored strain gauge. A stress corresponding to 0.8 times of the tensile strength (TS) was applied (e.g., in the case of A-1 shown in Table 2, the applied stress was 1,608 MPa×0.8=1,286 MPa). The reason for this is because the residual stress introduced to a steel sheet at the time of forming is believed to correspond to the TS of the steel sheet. The resulting U-bended test piece was immersed in an aqueous HCl solution having a pH of 3 at a solution temperature of 25° C. and retained for 48 hours under an atmospheric pressure of 950 to 1,070 hPa, after which the presence or absence of cracks was examined. An evaluation of "x" was given when a crack of greater than 3 mm in length was observed on the U-bended test piece, an evaluation of "◇" was given when an acceptable fine crack of less than 3 mm in length was observed on an end surface, and an evaluation of "○" was given when no crack was observed. The evaluations of "○" and "◇" were regarded as passing grades, while the evaluation of "x" was regarded as a failing grade.

A steel sheet was evaluated to have a high strength and excellent hydrogen embrittlement resistance when the tensile strength was 1,300 MPa or higher and the evaluation of the hydrogen embrittlement resistance was "○".

TABLE 1

| | Component (% by mass) | | | | | | | | | | | | | | |
|---|---|---|---|---|---|---|---|---|---|---|---|---|---|---|---|
| No. | C | Si | Mn | P | S | Al | N | Co | Ni | Mo | Cr | O | Ti | B | Nb |
| A | 0.21 | 1.17 | 4.17 | 0.0164 | 0.0015 | 0.065 | 0.0014 | 0.26 | 0.11 | 0.07 | 0.525 | 0.0167 | 0.037 | 0.0028 | 0.022 |
| B | 0.24 | 0.80 | 1.57 | 0.0015 | 0.0009 | 0.109 | 0.0010 | — | — | — | — | — | — | — | — |
| C | 0.34 | 1.94 | 1.29 | 0.0059 | 0.0030 | 0.154 | 0.0107 | 0.10 | 0.05 | 0.08 | 0.223 | 0.0019 | 0.084 | 0.0008 | 0.031 |
| D | 0.39 | 0.62 | 2.67 | 0.0018 | 0.0022 | 0.086 | 0.0168 | — | — | — | — | — | — | — | — |
| E | 0.21 | 1.75 | 0.27 | 0.0021 | 0.0019 | 0.086 | 0.0011 | — | — | — | — | — | — | — | — |
| F | 0.28 | 1.21 | 3.08 | 0.0021 | 0.0102 | 0.047 | 0.0035 | 0.04 | 0.11 | 0.11 | 0.337 | 0.0017 | 0.039 | 0.0055 | 0.024 |
| G | 0.35 | 1.38 | 3.57 | 0.0009 | 0.0009 | 0.079 | 0.0017 | — | — | — | — | — | — | — | — |
| H | 0.33 | 1.58 | 2.91 | 0.0013 | 0.0035 | 0.050 | 0.0022 | — | — | — | — | — | — | — | — |
| I | 0.22 | 0.96 | 1.85 | 0.0017 | 0.0016 | 0.507 | 0.0025 | 0.41 | 0.12 | 0.15 | 0.198 | 0.0110 | 0.041 | 0.0012 | 0.064 |
| J | 0.38 | 0.28 | 0.54 | 0.0110 | 0.0052 | 0.190 | 0.0052 | 0.05 | 0.28 | 0.16 | 0.073 | 0.0016 | 0.056 | 0.0008 | 0.058 |
| K | 0.19 | 0.82 | 2.41 | 0.0034 | 0.0147 | 0.031 | 0.0152 | — | — | — | — | — | — | — | — |
| L | 0.23 | 0.54 | 2.19 | 0.0013 | 0.0016 | 0.068 | 0.0024 | — | — | — | — | — | — | — | — |
| M | 0.26 | 0.13 | 1.84 | 0.0019 | 0.0011 | 0.081 | 0.0015 | 0.07 | 0.10 | 0.26 | 0.150 | 0.0150 | 0.027 | 0.0007 | 0.043 |
| N | 0.28 | 0.32 | 3.94 | 0.0155 | 0.0163 | 0.266 | 0.0011 | — | — | — | — | — | — | — | — |
| O | 0.31 | 0.85 | 4.46 | 0.0029 | 0.0023 | 0.815 | 0.0025 | — | — | — | — | — | — | — | — |
| P | **0.14** | 0.13 | 1.28 | 0.0117 | 0.0057 | 0.072 | 0.0016 | — | — | — | — | — | — | — | — |
| Q | **0.41** | 1.19 | 2.56 | 0.0022 | 0.0027 | 0.088 | 0.0018 | — | — | — | — | — | — | — | — |
| R | 0.32 | **2.06** | 2.34 | 0.0012 | 0.0065 | 0.120 | 0.0014 | — | — | — | — | — | — | — | — |
| S | 0.35 | 1.73 | **0.04** | 0.0015 | 0.0017 | 0.078 | 0.0018 | — | — | — | — | — | — | — | — |
| T | 0.32 | 1.68 | **5.11** | 0.0021 | 0.0016 | 0.103 | 0.0020 | — | — | — | — | — | — | — | — |
| U | 0.30 | 1.37 | 3.59 | **0.0206** | 0.0014 | 0.092 | 0.0012 | 0.04 | 0.09 | 0.77 | 0.115 | 0.0013 | 0.037 | 0.0013 | 0.402 |
| V | 0.25 | 0.38 | 1.51 | 0.0018 | **0.0208** | 0.110 | 0.0162 | 0.05 | 0.64 | 0.09 | 0.905 | 0.0131 | 0.232 | 0.0080 | 0.081 |
| W | 0.34 | 0.23 | 2.14 | 0.0019 | 0.0027 | **1.037** | 0.0018 | — | — | — | — | — | — | — | — |
| X | 0.32 | 1.80 | 2.82 | 0.0079 | 0.0011 | 0.034 | **0.0207** | 0.04 | 0.11 | 0.09 | 0.185 | 0.0156 | 0.047 | 0.0006 | 0.423 |
| Y | 0.38 | 0.48 | 0.30 | 0.0026 | 0.0024 | 0.618 | 0.0026 | **0.52** | 0.82 | 0.10 | 0.117 | 0.0013 | 0.030 | 0.0084 | 0.044 |
| Z | 0.21 | 1.53 | 4.51 | 0.0010 | 0.0134 | 0.101 | 0.0016 | 0.31 | **1.02** | 0.10 | 0.149 | 0.0017 | 0.067 | 0.0007 | 0.342 |
| AA | 0.24 | 0.97 | 0.40 | 0.0012 | 0.0115 | 0.178 | 0.0012 | 0.06 | 0.52 | **1.02** | 1.664 | 0.0148 | 0.287 | 0.0068 | 0.054 |
| AB | 0.29 | 1.75 | 4.78 | 0.0050 | 0.0037 | 0.114 | 0.0046 | 0.05 | 0.35 | 0.83 | **2.048** | 0.0023 | 0.047 | 0.0081 | 0.087 |
| AC | 0.39 | 0.21 | 1.97 | 0.0018 | 0.0017 | 0.309 | 0.0017 | 0.08 | 0.73 | 0.08 | 0.404 | **0.0206** | 0.052 | 0.0052 | 0.027 |
| AD | 0.24 | 0.98 | 1.09 | 0.0021 | 0.0092 | 0.082 | 0.0021 | 0.42 | 0.08 | 0.08 | 0.194 | 0.0015 | **0.515** | 0.0014 | 0.024 |
| AE | 0.28 | 0.15 | 1.00 | 0.0101 | 0.0024 | 0.248 | 0.0019 | 0.23 | 0.06 | 0.07 | 0.193 | 0.0152 | 0.073 | **0.0104** | 0.412 |
| AF | 0.20 | 1.02 | 1.51 | 0.0161 | 0.0020 | 0.065 | 0.0009 | 0.11 | 0.06 | 0.10 | 0.174 | 0.0080 | 0.036 | 0.0016 | **0.511** |
| AG | 0.17 | 0.60 | 3.95 | 0.0043 | 0.0017 | 0.054 | 0.0048 | 0.04 | 0.06 | 0.10 | 0.258 | 0.0020 | 0.031 | 0.0004 | 0.059 |
| AH | 0.22 | 1.27 | 1.91 | 0.0088 | 0.0016 | 0.110 | 0.0011 | 0.17 | 0.11 | 0.08 | 0.195 | 0.0021 | 0.112 | 0.0078 | 0.038 |
| AI | 0.20 | 0.58 | 0.42 | 0.0031 | 0.0020 | 0.073 | 0.0011 | 0.07 | 0.30 | 0.10 | 0.149 | 0.0026 | 0.139 | 0.0044 | 0.104 |
| AJ | 0.29 | 1.43 | 2.89 | 0.0050 | 0.0012 | 0.075 | 0.0045 | 0.13 | 0.09 | 0.10 | 0.174 | 0.0013 | 0.128 | 0.0021 | 0.044 |
| AK | 0.23 | 1.66 | 4.44 | 0.0014 | 0.0013 | 0.429 | 0.0160 | 0.08 | 0.82 | 0.13 | 0.565 | 0.0030 | 0.037 | 0.0012 | 0.040 |
| AL | 0.19 | 0.71 | 4.21 | 0.0172 | 0.0017 | 0.103 | 0.0023 | 0.07 | 0.11 | 0.08 | 0.169 | 0.0035 | 0.043 | 0.0007 | 0.040 |
| AM | 0.30 | 1.83 | 2.54 | 0.0026 | 0.0020 | 0.141 | 0.0013 | 0.06 | 0.80 | 0.12 | 0.181 | 0.0009 | 0.337 | 0.0007 | 0.031 |
| AN | 0.25 | 1.60 | 3.49 | 0.0018 | 0.0167 | 0.116 | 0.0038 | 0.04 | 0.06 | 0.14 | 0.355 | 0.0120 | 0.031 | 0.0010 | 0.064 |
| AO | 0.23 | 1.13 | 2.28 | 0.0010 | 0.0021 | 0.090 | 0.0138 | 0.07 | 0.07 | 0.71 | 0.190 | 0.0035 | 0.059 | 0.0006 | 0.041 |
| AP | 0.28 | 1.06 | 2.97 | 0.0014 | 0.0015 | 0.035 | 0.0062 | 0.06 | 0.11 | 0.09 | 0.124 | 0.0020 | 0.042 | 0.0009 | 0.050 |
| AQ | 0.34 | 0.61 | 3.25 | 0.0127 | 0.0030 | 0.108 | 0.0023 | 0.06 | 0.12 | 0.28 | 0.111 | 0.0015 | 0.067 | 0.0011 | 0.145 |
| AR | 0.31 | 0.76 | 2.90 | 0.0031 | 0.0160 | 0.724 | 0.0124 | 0.07 | 0.04 | 0.06 | 0.178 | 0.0020 | 0.189 | 0.0061 | 0.046 |
| AS | 0.36 | 1.23 | 2.47 | 0.0016 | 0.0022 | 0.179 | 0.0015 | 0.06 | 0.76 | 0.35 | 1.380 | 0.0017 | 0.353 | 0.0006 | 0.036 |
| AT | 0.25 | 0.51 | 2.87 | 0.0113 | 0.0027 | 0.022 | 0.0038 | — | — | 0.05 | — | 0.0010 | 0.035 | 0.0022 | — |

TABLE 1-continued

| No. | Component (% by mass) | | | | | | | | | | | | | Note |
|---|---|---|---|---|---|---|---|---|---|---|---|---|---|---|
| | V | Cu | W | Ta | Sn | Sb | As | Mg | Ca | Y | Zr | La | Ce | |
| A | 0.036 | 0.038 | 0.006 | 0.014 | 0.009 | 0.027 | 0.003 | 0.0415 | 0.005 | 0.003 | 0.010 | 0.006 | 0.014 | developed steel |
| B | — | — | — | — | — | — | — | — | — | — | — | — | — | developed steel |
| C | 0.044 | 0.036 | 0.011 | 0.013 | 0.028 | 0.004 | 0.026 | 0.0053 | 0.004 | 0.007 | 0.003 | 0.005 | 0.026 | developed steel |
| D | — | — | — | — | — | — | — | — | — | — | — | — | — | developed steel |
| E | — | — | — | — | — | — | — | — | — | — | — | — | — | developed steel |
| F | 0.057 | 0.253 | 0.009 | 0.076 | 0.006 | 0.004 | 0.005 | 0.0124 | 0.009 | 0.041 | 0.008 | 0.006 | 0.006 | developed steel |
| G | — | — | — | — | — | — | — | — | — | — | — | — | — | developed steel |
| H | — | — | — | — | — | — | — | — | — | — | — | — | — | developed steel |
| I | 0.032 | 0.058 | 0.008 | 0.007 | 0.005 | 0.005 | 0.013 | 0.0039 | 0.037 | 0.036 | 0.005 | 0.003 | 0.006 | developed steel |
| J | 0.382 | 0.033 | 0.017 | 0.013 | 0.004 | 0.006 | 0.005 | 0.0024 | 0.004 | 0.010 | 0.042 | 0.005 | 0.041 | developed steel |
| K | — | — | — | — | — | — | — | — | — | — | — | — | — | developed steel |
| L | — | — | — | — | — | — | — | — | — | — | — | — | — | developed steel |
| M | 0.045 | 0.098 | 0.074 | 0.005 | 0.004 | 0.003 | 0.005 | 0.0045 | 0.006 | 0.004 | 0.003 | 0.005 | 0.004 | developed steel |
| N | — | — | — | — | — | — | — | — | — | — | — | — | — | developed steel |
| O | — | — | — | — | — | — | — | — | — | — | — | — | — | developed steel |
| P | — | — | — | — | — | — | — | — | — | — | — | — | — | comparative steel |
| Q | — | — | — | — | — | — | — | — | — | — | — | — | — | comparative steel |
| R | — | — | — | — | — | — | — | — | — | — | — | — | — | comparative steel |
| S | — | — | — | — | — | — | — | — | — | — | — | — | — | comparative steel |
| T | — | — | — | — | — | — | — | — | — | — | — | — | — | comparative steel |
| U | 0.051 | 0.046 | 0.024 | 0.012 | 0.006 | 0.015 | 0.008 | 0.0063 | 0.028 | 0.006 | 0.003 | 0.010 | 0.006 | comparative steel |
| V | 0.092 | 0.048 | 0.016 | 0.014 | 0.005 | 0.004 | 0.039 | 0.0034 | 0.008 | 0.014 | 0.005 | 0.003 | 0.004 | comparative steel |
| W | — | — | — | — | — | — | — | — | — | — | — | — | — | comparative steel |
| X | 0.042 | 0.033 | 0.073 | 0.070 | 0.008 | 0.006 | 0.027 | 0.0030 | 0.018 | 0.041 | 0.006 | 0.004 | 0.005 | comparative steel |
| Y | 0.067 | 0.171 | 0.050 | 0.033 | 0.005 | 0.004 | 0.034 | 0.0061 | 0.008 | 0.003 | 0.006 | 0.043 | 0.005 | comparative steel |
| Z | 0.052 | 0.030 | 0.012 | 0.062 | 0.011 | 0.005 | 0.008 | 0.0360 | 0.005 | 0.004 | 0.038 | 0.032 | 0.007 | comparative steel |
| AA | 0.048 | 0.051 | 0.008 | 0.065 | 0.008 | 0.005 | 0.005 | 0.0051 | 0.005 | 0.003 | 0.031 | 0.039 | 0.010 | comparative steel |
| AB | 0.070 | 0.049 | 0.012 | 0.007 | 0.004 | 0.009 | 0.042 | 0.0120 | 0.010 | 0.004 | 0.005 | 0.004 | 0.005 | comparative steel |
| AC | 0.039 | 0.033 | 0.014 | 0.019 | 0.040 | 0.006 | 0.036 | 0.0425 | 0.022 | 0.007 | 0.039 | 0.003 | 0.004 | comparative steel |
| AD | 0.061 | 0.046 | 0.022 | 0.025 | 0.005 | 0.012 | 0.006 | 0.0410 | 0.004 | 0.011 | 0.004 | 0.004 | 0.006 | comparative steel |
| AE | 0.064 | 0.044 | 0.007 | 0.022 | 0.004 | 0.037 | 0.006 | 0.0091 | 0.005 | 0.010 | 0.022 | 0.027 | 0.004 | comparative steel |
| AF | 0.067 | 0.301 | 0.005 | 0.011 | 0.007 | 0.007 | 0.024 | 0.0055 | 0.003 | 0.005 | 0.005 | 0.008 | 0.040 | comparative steel |
| AG | **0.513** | 0.031 | 0.078 | 0.010 | 0.006 | 0.033 | 0.005 | 0.0176 | 0.004 | 0.022 | 0.007 | 0.003 | 0.032 | comparative steel |
| AH | 0.030 | **0.518** | 0.008 | 0.010 | 0.005 | 0.038 | 0.003 | 0.0025 | 0.006 | 0.010 | 0.017 | 0.004 | 0.041 | comparative steel |
| AI | 0.035 | 0.037 | **0.104** | 0.008 | 0.003 | 0.007 | 0.006 | 0.0411 | 0.032 | 0.005 | 0.018 | 0.004 | 0.003 | comparative steel |
| AJ | 0.131 | 0.101 | 0.005 | **0.103** | 0.023 | 0.005 | 0.005 | 0.0055 | 0.037 | 0.039 | 0.005 | 0.012 | 0.010 | comparative steel |
| AK | 0.383 | 0.324 | 0.016 | 0.018 | **0.052** | 0.007 | 0.014 | 0.0160 | 0.006 | 0.028 | 0.010 | 0.037 | 0.028 | comparative steel |
| AL | 0.197 | 0.024 | 0.013 | 0.010 | 0.005 | **0.051** | 0.004 | 0.0023 | 0.006 | 0.003 | 0.043 | 0.013 | 0.006 | comparative steel |
| AM | 0.054 | 0.055 | 0.013 | 0.010 | 0.006 | 0.004 | **0.051** | 0.0035 | 0.015 | 0.043 | 0.005 | 0.010 | 0.006 | comparative steel |
| AN | 0.248 | 0.162 | 0.077 | 0.013 | 0.034 | 0.029 | 0.006 | **0.0519** | 0.038 | 0.005 | 0.004 | 0.008 | 0.013 | comparative steel |
| AO | 0.029 | 0.356 | 0.013 | 0.015 | 0.003 | 0.005 | 0.004 | 0.0050 | **0.051** | 0.005 | 0.006 | 0.006 | 0.005 | comparative steel |
| AP | 0.070 | 0.046 | 0.007 | 0.008 | 0.003 | 0.005 | 0.004 | 0.0059 | 0.006 | **0.051** | 0.008 | 0.040 | 0.011 | comparative steel |
| AQ | 0.046 | 0.100 | 0.007 | 0.050 | 0.007 | 0.005 | 0.005 | 0.0387 | 0.007 | 0.035 | **0.052** | 0.004 | 0.005 | comparative steel |
| AR | 0.040 | 0.070 | 0.008 | 0.017 | 0.040 | 0.018 | 0.011 | 0.0288 | 0.013 | 0.006 | 0.041 | **0.052** | 0.005 | comparative steel |
| AS | 0.411 | 0.029 | 0.011 | 0.011 | 0.003 | 0.005 | 0.004 | 0.0047 | 0.033 | 0.009 | 0.042 | 0.005 | **0.052** | comparative steel |
| AT | — | 0.082 | — | — | — | — | — | — | — | — | — | — | — | developed steel |

*Bold and underlined values are outside the scope of the present invention.

TABLE 2

| No. | Ferrite (%) | Total of martensite and tempered martensite (%) | Remaining structure (%) | $\sigma/M_{ave}$ | Circle-equivalent diameter of region with Mn concentration of higher than ($Mn_{ave}$ + 1.3σ) (μm) | Tensile strength (MPa) | Total elongation (%) | Hydrogen embrittlement resistance | Note |
|---|---|---|---|---|---|---|---|---|---|
| A-1 | 0.0 | 98.5 | 1.5 | 0.44 | 2.0 | 1,608 | 8.9 | ○ | Example |
| B-1 | 0.0 | 99.7 | 0.3 | 0.44 | 4.5 | 1,616 | 9.2 | ○ | Example |
| C-1 | 0.0 | 98.5 | 1.5 | 0.21 | 7.4 | 1,704 | 10.2 | ○ | Example |
| D-1 | 0.0 | 95.3 | 4.7 | 0.32 | 4.9 | 1,848 | 10.8 | ○ | Example |
| E-1 | 2.1 | 95.6 | 2.3 | 0.16 | 3.8 | 1,355 | 12 | ○ | Example |
| F-1 | 0.0 | 98.2 | 1.8 | 0.21 | 9.5 | 1,738 | 8.9 | ○ | Example |
| G-1 | 0.0 | 93.6 | 6.4 | 0.47 | 2.5 | 1,753 | 11.4 | ○ | Example |
| H-1 | 0.0 | 96.2 | 3.8 | 0.37 | 7.6 | 1,783 | 8.8 | ○ | Example |
| I-1 | 1.9 | 95.9 | 2.2 | 0.56 | 5.1 | 1,416 | 10.8 | ○ | Example |
| J-1 | 0.0 | 99.0 | 1.0 | 0.17 | 9.7 | 1,862 | 8.5 | ○ | Example |
| K-1 | 0.0 | 99.7 | 0.3 | 0.66 | 2.0 | 1,437 | 9.9 | ○ | Example |
| L-1 | 0.0 | 99.6 | 0.4 | 0.73 | 4.0 | 1,595 | 9.4 | ○ | Example |
| M-1 | 0.0 | 99.6 | 0.4 | 0.60 | 8.8 | 1,625 | 9.2 | ○ | Example |
| N-1 | 0.0 | 95.4 | 4.6 | 0.69 | 8.1 | 1,583 | 9.8 | ○ | Example |
| O-1 | 0.0 | 94.5 | 5.5 | 0.43 | 2.0 | 1,728 | 8.1 | ○ | Example |
| P-1 | 0.0 | 100.0 | 0.0 | 0.66 | 5.9 | **1,298** | 13.3 | ○ | Comparative Example |
| Q-1 | 0.0 | 93.6 | 6.4 | 0.32 | 2.5 | 1,897 | 10.9 | x | Comparative Example |

TABLE 2-continued

| No. | Ferrite (%) | Total of martensite and tempered martensite (%) | Remaining structure (%) | $\sigma/M_{ave}$ | Circle-equivalent diameter of region with Mn concentration of higher than ($Mn_{ave}$ + 1.3σ) (μm) | Tensile strength (MPa) | Total elongation (%) | Hydrogen embrittlement resistance | Note |
|---|---|---|---|---|---|---|---|---|---|
| R-1 | 4.2 | **84.4** | 11.4 | 0.16 | 9.3 | **1,262** | 11.6 | x | Comparative Example |
| S-1 | 0.0 | 99.2 | 0.8 | **0.01** | 3.2 | **1,118** | 10.1 | x | Comparative Example |
| T-1 | 0.0 | **85.7** | 14.3 | 0.30 | **12.0** | **1,265** | 9.6 | x | Comparative Example |
| U-1 | 0.0 | 96.3 | 3.7 | 0.56 | 9.7 | 1,715 | 11.7 | x | Comparative Example |
| V-1 | 0.0 | 99.5 | 0.5 | 0.37 | 6.0 | 1,656 | 8.5 | x | Comparative Example |
| W-1 | **19.5** | **60.1** | 20.4 | 0.73 | 7.5 | **1,137** | 11.9 | x | Comparative Example |
| X-1 | 0.0 | 97.1 | 2.9 | 0.94 | 7.7 | 1,671 | 9.8 | x | Comparative Example |
| Y-1 | 0.0 | 98.9 | 1.1 | **0.08** | 6.6 | 1,831 | 8.6 | x | Comparative Example |
| Z-1 | 0.0 | 97.3 | 2.7 | 0.59 | 6.8 | 1,591 | 9.5 | x | Comparative Example |
| AA-1 | 0.0 | 99.7 | 0.3 | **0.12** | 6.5 | 1,562 | 13.8 | x | Comparative Example |
| AB-1 | 0.0 | **87.5** | 12.5 | 0.30 | 3.3 | **1,236** | 13.3 | x | Comparative Example |
| AC-1 | 0.0 | 96.9 | 3.1 | 0.64 | 9.5 | 1,868 | 7.6 | x | Comparative Example |
| AD-1 | 0.0 | 99.8 | 0.2 | 0.26 | 3.6 | 1,613 | 9.7 | x | Comparative Example |
| AE-1 | 0.0 | 99.7 | 0.3 | 0.22 | 1.7 | 1,611 | 8.8 | x | Comparative Example |
| AF-1 | 0.0 | 99.8 | 0.2 | 0.31 | 9.1 | 1,555 | 10 | x | Comparative Example |
| AG-1 | 0.0 | 99.5 | 0.5 | 0.76 | 7.2 | 1,480 | 9.1 | x | Comparative Example |
| AH-1 | 0.0 | 99.6 | 0.4 | 0.23 | 7.1 | 1,613 | 9.8 | x | Comparative Example |
| AI-1 | **8.7** | 91.2 | 0.1 | **0.13** | 5.0 | 1,350 | 11 | x | Comparative Example |
| AJ-1 | 0.0 | 98.1 | 1.9 | 0.77 | 3.0 | 1,761 | 9.1 | x | Comparative Example |
| AK-1 | 0.0 | 96.4 | 3.6 | 0.65 | 6.8 | 1,642 | 9.4 | x | Comparative Example |
| AL-1 | 0.0 | 99.1 | 0.9 | 0.17 | 2.2 | 1,543 | 8.8 | x | Comparative Example |
| AM-1 | 0.0 | 97.5 | 2.5 | 0.47 | 2.0 | 1,651 | 10.2 | x | Comparative Example |
| AN-1 | 0.0 | 98.2 | 1.8 | 0.91 | 7.3 | 1,686 | 9.5 | x | Comparative Example |
| AO-1 | 0.0 | 99.4 | 0.6 | 0.22 | 2.6 | 1,616 | 12.2 | x | Comparative Example |
| AP-1 | 0.0 | 98.5 | 1.5 | 0.47 | 3.0 | 1,597 | 9.3 | x | Comparative Example |
| AQ-1 | 0.0 | 96.5 | 3.5 | 0.89 | 9.3 | 1,796 | 8.7 | x | Comparative Example |
| AR-1 | 0.0 | 98.1 | 1.9 | 0.67 | 1.3 | 1,743 | 8.3 | x | Comparative Example |
| AS-1 | 0.0 | 94.8 | 5.2 | 0.76 | 7.7 | 1,831 | 9.3 | x | Comparative Example |
| AT-1 | 0.0 | 97.5 | 2.5 | 0.50 | 2.1 | 1,555 | 11.1 | ○ | Example |

*Bold and underlined values are outside the scope of the present invention.

Referring to Table 2, in Example P-1, the tensile strength was lower than 1,300 MPa due to the low C content. In Example Q-1, the hydrogen embrittlement resistance was reduced due to the high C content. In Example R-1, due to the high Si content, concentration of Mn was inhibited, and the hydrogen embrittlement resistance was reduced. In Example S-1, the tensile strength was lower than 1,300 MPa due to the low Mn content. In addition, since the standard deviation a of the Mn concentration did not satisfy a 0.15 $Mn_{ave}$, the hydrogen embrittlement resistance was reduced. In Example T-1, since the circle-equivalent diameter of the region with a Mn concentration of ($Mn_{ave}$+1.3σ) was large, an effect of improving the hydrogen embrittlement resistance was not obtained. In Example U-1, since the P content was high, the hydrogen embrittlement resistance was reduced due to embrittlement of grain boundaries. In Example V-1, the hydrogen embrittlement resistance was reduced due to the high S content. In Example W-1, coarse Al oxide was generated due to the high Al content, and the hydrogen embrittlement resistance was reduced. In Example X-1, coarse nitrides were generated due to the high N content, and the hydrogen embrittlement resistance was reduced.

In Example Y-1, coarse Co carbide precipitated due to the high Co content, as a result of which the hydrogen embrittlement resistance was reduced. In Example Z-1, the hydrogen embrittlement resistance was reduced due to the high Ni content. In Example AA-1, since the standard deviation a did not satisfy σ≥0.15 $Mn_{ave}$, the hydrogen embrittlement resistance was reduced. In Example AB-1, coarse Cr carbide was generated due to the high Cr content, as a result of which the hydrogen embrittlement resistance was reduced. In Example AC-1, oxides were formed due to the high O content, and the hydrogen embrittlement resistance was reduced. In Example AD-1, a large amount of carbonitride precipitated due to the high Ti content, and the hydrogen embrittlement resistance was reduced. In Example AE-1, coarse B oxide was generated in the steel due to the high B content, as a result of which the hydrogen embrittlement resistance was reduced. In Example AF-1, coarse Nb carbide was generated due to the high Nb content, and the hydrogen embrittlement resistance was reduced. In Example AG-1, a large amount of carbonitride precipitated due to the high V content, and the hydrogen embrittlement resistance was reduced.

In Example AH-1, due to the high Cu content, the steel sheet was embrittled and the hydrogen embrittlement resistance was reduced. In Example AI-1, coarse W precipitates were generated due to the high W content, and the hydrogen embrittlement resistance was reduced. In Example AJ-1, a large amount of fine Ta carbide precipitated due to the high Ta content, and the hydrogen embrittlement resistance was reduced. In Example AK-1, embrittlement of grain boundaries occurred due to the high Sn content, and the hydrogen embrittlement resistance was thereby reduced. In Examples AL-1 and AM-1, grain boundary segregation occurred due to the high Sb content and the high As content, respectively, and the hydrogen embrittlement resistance was thereby reduced. In Examples AN-1 and AO-1, coarse inclusions were formed due to the high Mg content and the high Ca content, respectively, and the hydrogen embrittlement resistance was thereby reduced. In Examples AP-1 to AS-1, coarse oxides were generated due to the high content of Y, Zr, La and Ce, respectively, and the hydrogen embrittlement resistance was thereby reduced.

In contrast to the above, in Examples A-1 to O-1, steel sheets having a high strength and excellent hydrogen embrittlement resistance were obtained by appropriately controlling the chemical composition and the structure of each steel sheet as well as the Mn-concentrated region in each steel sheet.

Example 2

Further, in order to investigate the effects of the production conditions, hot-rolled steel sheets of 2.3 mm in thickness were produced by performing thermo-mechanical treatments in accordance with the production conditions shown in Table 3 on the respective steel species A to O that had been confirmed to have excellent properties as shown in Table 2, and the properties of these steel sheets were evaluated after cold rolling and annealing. The symbols GI and GA under "Plating treatment" each indicate a method of galvanization treatment. The symbol GI represents a steel sheet which was immersed in a 460° C. hot-dip galvanizing bath and thereby provided with a galvanized layer on the surface, and the symbol GA represents a steel sheet which was immersed in a hot-dip galvanizing bath, subsequently heated to 485° C., and thereby provided with an alloy layer of iron and zinc on the surface. In addition, on each of the steel sheets, a tempering treatment, in which the steel sheet once cooled to 150° C. was reheated and retained for 2 to 120 seconds in a period between retention of the steel sheet at the respective retention temperatures in cold-rolled sheet annealing and subsequent cooling of the steel sheet to room temperature, was performed. It is noted here that, in those Examples where the tempering time was in a range of 7,200 to 33,000 seconds, each steel sheet wound into a coil form after being cooled to room temperature was tempered using a separate annealing apparatus (box annealing furnace). Moreover, in those Examples with a description of "-" for tempering in Table 3, tempering was not performed. The thus obtained results are shown in Table 4. As for the methods of evaluating the properties, the same methods were employed as in Example 1.

TABLE 3

| | Hot rolling | | | | | | | Cold-rolling | Cold-rolled sheet annealing | |
|---|---|---|---|---|---|---|---|---|---|---|
| No. | Finish-rolling start temperature (° C.) | Number of rolling operations at reduction ratio of 20% or higher | Pass interval at reduction ratio of 20% or higher (sec) | Finish-rolling termination temperature (° C.) | Time until start of cooling (sec) | Average cooling rate (° C./sec) | Coiling temperature (° C.) | reduction ratio (%) | Heating rate (° C./sec) | Annealing temperature (° C.) |
| A-2 | 1,116 | 6 | 3.0 | 933 | 1.7 | 28.8 | 523 | 49.3 | 75.1 | 825 |
| B-2 | 1,010 | 4 | 2.1 | 739 | 1.1 | 36.9 | 471 | 18.3 | 46.4 | 815 |
| C-2 | 1,131 | **1** | 1.4 | 849 | 3.8 | 41.7 | 497 | 77.4 | 50.6 | 863 |
| D-2 | 998 | 5 | 4.9 | 884 | 3.6 | 39.6 | 658 | 11.4 | 61.3 | 836 |
| E-2 | 1,055 | 4 | 1.7 | 780 | 3.0 | 33.0 | 690 | 26.5 | 53.9 | 895 |
| F-2 | 957 | 3 | 4.4 | 730 | 2.5 | 34.7 | 489 | 72.3 | 87.6 | 842 |
| G-2 | 1,071 | 4 | 3.1 | 802 | 4.2 | 26.4 | 623 | 37.5 | 69.3 | 833 |
| H-2 | 1,012 | 2 | 3.5 | 735 | 2.1 | 35.0 | 575 | 36.8 | 90.3 | 887 |
| I-2 | 1,092 | 6 | 3.5 | 693 | 1.3 | 25.5 | 557 | 53.3 | 12.6 | 887 |
| J-2 | 1,021 | 6 | **0.1** | 778 | 1.6 | 42.0 | 482 | 17.0 | 46.8 | 868 |
| K-2 | 1,065 | 3 | 4.0 | 680 | 3.8 | 20.8 | 548 | 22.3 | 85.0 | 848 |
| L-2 | 981 | 4 | 2.5 | 760 | 2.7 | 44.1 | 595 | 45.9 | 33.1 | 859 |
| M-2 | 1,079 | 4 | 3.1 | 821 | 2.7 | 35.0 | **709** | 20.8 | 80.5 | 862 |
| N-2 | 1,142 | 4 | 0.8 | 903 | 4.0 | 41.4 | 636 | 63.1 | 1.8 | 866 |
| O-2 | 969 | 3 | 2.1 | 857 | 4.5 | 46.7 | 674 | 67.1 | 51.4 | 883 |
| A-3 | 1,095 | 3 | 2.2 | 772 | **5.1** | 37.5 | 557 | 51.1 | 3.3 | 828 |
| B-3 | 1,035 | 5 | 1.5 | 661 | 2.0 | 30.7 | 580 | 38.7 | 16.5 | 869 |
| C-3 | 976 | 6 | 0.5 | 925 | 3.5 | 39.4 | 570 | 29.9 | 85.5 | **904** |
| D-3 | 1,021 | 3 | 0.5 | 814 | 2.1 | 23.6 | 462 | 32.3 | 36.7 | 874 |
| E-3 | 1,031 | 4 | 4.1 | **957** | 2.0 | 45.4 | 568 | 42.7 | 47.4 | 891 |
| F-3 | 1,107 | 5 | 0.9 | 924 | 4.7 | 42.6 | 504 | 75.6 | 95.3 | 884 |
| G-3 | 1,094 | 5 | 3.8 | 666 | 3.0 | 44.2 | 480 | 23.9 | 25.6 | **796** |
| H-3 | 989 | 3 | 1.2 | 894 | **0.9** | 29.4 | 627 | 22.4 | 59.3 | 848 |
| I-3 | 1,128 | 4 | 4.1 | 842 | 3.3 | 48.1 | 605 | 60.1 | 25.9 | 885 |
| J-3 | 1,101 | 8 | 1.6 | 735 | 3.1 | 42.8 | 655 | 16.2 | 68.7 | 840 |
| K-3 | 1,041 | 5 | 0.5 | 913 | 2.5 | 33.3 | 461 | 71.3 | 34.1 | 857 |
| L-3 | 1,064 | 6 | 0.9 | 884 | 3.5 | 27.2 | 534 | 56.3 | 25.7 | 855 |
| M-3 | **943** | 4 | 1.9 | 686 | 4.5 | 39.8 | 489 | 62.4 | 64.4 | 819 |
| N-3 | 1,009 | 4 | 2.8 | 754 | 2.5 | 30.9 | **440** | 28.2 | 33.7 | 851 |
| O-3 | 1,135 | 7 | 4.2 | 797 | 1.4 | 35.9 | 602 | 64.9 | 24.0 | 878 |
| A-4 | 1,125 | 3 | 4.3 | 932 | 3.8 | 39.3 | 673 | 32.9 | 7.6 | 887 |
| B-4 | 1,099 | 5 | 4.4 | 865 | 3.3 | 44.7 | 620 | 70.7 | 39.0 | 881 |
| C-4 | 969 | 9 | 4.4 | 855 | 3.9 | 27.5 | 480 | 47.5 | 92.8 | 862 |
| D-4 | 1,082 | 6 | 2.9 | 764 | 2.7 | 26.3 | 586 | 60.0 | 56.4 | 895 |
| E-4 | 1,140 | 6 | 2.5 | 707 | 2.9 | **19.2** | 580 | 31.2 | 29.5 | 887 |
| F-4 | 1,057 | 4 | 2.3 | 926 | 4.3 | 20.6 | 552 | 48.9 | 40.5 | 820 |
| G-4 | 1,005 | 5 | 4.7 | 782 | 1.2 | 30.0 | 676 | 16.7 | 69.9 | 860 |
| H-4 | 999 | 3 | 4.6 | 940 | 2.3 | 22.7 | 668 | 72.2 | 41.6 | 818 |
| I-4 | 1,158 | 6 | 1.4 | 816 | 1.7 | 30.3 | 559 | 46.9 | 58.7 | 887 |
| J-4 | 1,117 | 5 | 3.3 | 906 | 4.1 | 37.4 | 548 | 61.6 | 34.0 | 860 |
| K-4 | 1,034 | 5 | 0.4 | 638 | 4.7 | 45.7 | 529 | 53.6 | 14.5 | 836 |
| L-4 | 1,085 | 3 | 5.1 | 721 | 2.1 | 24.7 | 606 | 18.6 | 71.9 | 885 |
| M-4 | 984 | 3 | 1.5 | 758 | 3.9 | 46.0 | 691 | 39.7 | 75.5 | 876 |

TABLE 3-continued

| | | | | | | | | | | |
|---|---|---|---|---|---|---|---|---|---|---|
| N-4 | 966 | 4 | 0.8 | 768 | 2.2 | 46.5 | 674 | 62.9 | 17.4 | 881 |
| O-4 | 1,023 | 5 | 1.7 | 711 | 3.1 | **51.1** | 612 | 40.5 | 12.5 | 879 |

| | Cold-rolled sheet annealing | | | | | | Cold-rolled sheet annealing | | |
|---|---|---|---|---|---|---|---|---|---|
| No. | Retention time (sec) | Average cooling rate (° C./sec) | Cooling stop temperature (° C.) | Retention temperature (° C.) | Retention time (sec) | Plating treatment | Tempering temperature (° C.) | Tempering time (sec) | Note |
| A-2 | 573 | 19.8 | 202 | 207 | 222 | none | 255 | 17 | Example |
| B-2 | 70 | 87.2 | 517 | 520 | 298 | none | 341 | 39 | Example |
| C-2 | 138 | 82.5 | 519 | 532 | 93 | none | 178 | 46 | Comparative Example |
| D-2 | 125 | 69.8 | 193 | 218 | 196 | GA | — | — | Example |
| E-2 | 332 | 83.8 | 328 | 441 | 375 | none | 258 | 39 | Example |
| F-2 | 467 | 14.6 | 95 | 374 | 457 | none | 240 | 17 | Example |
| G-2 | 43 | 7.6 | 468 | 460 | 346 | none | 351 | 34 | Example |
| H-2 | 185 | 9.6 | 211 | 353 | 176 | none | 374 | 27 | Comparative Example |
| I-2 | 365 | 77.0 | 242 | 488 | 592 | none | 244 | 30 | Example |
| J-2 | 381 | 80.2 | 396 | 445 | 464 | none | 389 | 28 | Comparative Example |
| K-2 | 201 | 65.6 | 158 | 530 | 122 | none | 289 | 15 | Example |
| L-2 | 510 | 49.8 | 347 | 404 | 252 | GA | 293 | 52 | Example |
| M-2 | 235 | 76.9 | 471 | 471 | 292 | none | 203 | 51 | Comparative Example |
| N-2 | 260 | 47.2 | 275 | 415 | 543 | GI | 160 | 20 | Example |
| O-2 | 243 | 55.2 | 59 | 504 | 415 | none | 232 | 38 | Example |
| A-3 | 286 | 11.4 | 331 | 348 | 381 | none | 251 | 25 | Comparative Example |
| B-3 | 145 | 93.8 | 180 | 464 | 496 | none | 192 | 7,200 | Example |
| C-3 | 21 | 17.9 | 213 | 276 | 537 | none | 188 | 23 | Comparative Example |
| D-3 | 535 | 29.8 | 113 | 288 | 49 | none | 330 | 12 | Example |
| E-3 | 52 | 39.7 | 461 | 532 | 63 | none | 194 | 16 | Comparative Example |
| F-3 | 433 | 24.1 | 505 | 505 | 141 | none | 206 | 33,000 | Example |
| G-3 | 45 | 73.4 | 281 | 505 | 570 | none | 319 | 44 | Comparative Example |
| H-3 | 81 | 42.5 | 250 | 374 | 496 | none | 254 | 42 | Comparative Example |
| I-3 | 296 | 39.2 | 190 | 268 | 84 | GA | 220 | 300 | Example |
| J-3 | 291 | 68.5 | 221 | 421 | 232 | GA | 169 | 53 | Example |
| K-3 | 258 | 49.2 | 546 | 546 | 70 | GI | — | — | Example |
| L-3 | 429 | 93.0 | 506 | 506 | 196 | none | 219 | 31 | Example |
| M-3 | 459 | 24.9 | 184 | 393 | 364 | none | 393 | 55 | Comparative Example |
| N-3 | 531 | 54.8 | 166 | 458 | 448 | none | 329 | 12 | Comparative Example |
| O-3 | 171 | 23.7 | 96 | 363 | 468 | none | — | — | Example |
| A-4 | 262 | 19.5 | 250 | 412 | 329 | GA | 269 | 32 | Example |
| B-4 | 562 | 65.3 | 156 | 447 | 211 | GA | 341 | 16 | Example |
| C-4 | 160 | 12.6 | 218 | 501 | 499 | none | 159 | 16 | Example |
| D-4 | 199 | 15.9 | 263 | 266 | 317 | none | 194 | 18,000 | Example |
| E-4 | 345 | 28.6 | 222 | 492 | 132 | none | 183 | 17 | Comparative Example |
| F-4 | 89 | 51.7 | 532 | 532 | 178 | GI | 343 | 250 | Example |
| G-4 | 347 | 92.8 | 549 | 550 | 149 | none | 324 | 100 | Example |
| H-4 | 380 | 68.9 | 361 | 468 | 77 | none | 278 | 51 | Example |
| I-4 | 173 | 84.5 | 299 | 413 | 423 | none | 221 | 15 | Comparative Example |
| J-4 | 255 | 45.9 | 358 | 458 | 56 | none | 384 | 49 | Example |
| K-4 | 63 | 54.7 | 171 | 438 | 469 | none | 242 | 52 | Comparative Example |
| L-1 | 488 | 72.7 | 166 | 227 | 124 | none | 266 | 54 | Comparative Example |
| M-4 | 492 | 37.5 | 369 | 431 | 165 | none | 369 | 20 | Example |
| N-4 | 404 | 9.7 | 101 | 513 | 315 | none | 283 | 51 | Example |
| O-4 | 142 | 48.3 | 330 | 392 | 18 | none | 384 | 50 | Comparative Example |

*Bold and underlined values are outside the scope of the present invention.

TABLE 4

| No. | Ferrite (%) | Martensite and tempered martensite (%) | Remaining structure (%) | $\sigma/M_{ave}$ | Circle-equivalent diameter of region with Mn concentration of higher than ($Mn_{ave}$ + 1.3σ) (μm) | Tensile strength (MPa) | Total elongation (%) | Hydrogen embrittlement resistance | Note |
|---|---|---|---|---|---|---|---|---|---|
| A-2 | 4.2 | 90.3 | 5.5 | 0.93 | 4.9 | 1,417 | 9.8 | ◇ | Example |
| B-2 | 3.0 | 93.7 | 3.3 | 0.51 | 2.9 | 1,333 | 10.8 | ○ | Example |
| C-2 | 1.5 | 95.6 | 2.9 | 0.39 | **11.6** | 1,694 | 10.3 | x | Comparative Example |
| D-2 | 0.0 | 95.3 | 4.7 | 0.48 | 5.7 | 1,812 | 10.9 | ○ | Example |
| E-2 | 0.0 | 99.8 | 0.2 | 0.16 | 6.4 | 1,332 | 12.1 | ○ | Example |
| F-2 | 0.0 | 98.2 | 1.8 | 0.58 | 1.4 | 1,684 | 9.1 | ○ | Example |
| G-2 | 0.0 | 93.6 | 6.4 | 0.49 | 5.9 | 1,463 | 13.3 | ○ | Example |
| H-2 | 0.0 | 96.2 | 3.8 | 0.35 | **13.2** | 1,480 | 10.2 | x | Comparative Example |
| I-2 | 3.6 | 92.5 | 3.9 | 0.49 | 3.8 | 1,318 | 11.5 | ○ | Example |
| J-2 | 0.0 | 99.0 | 1.0 | 0.17 | **18.3** | 1,468 | 10.2 | x | Comparative Example |

TABLE 4-continued

| No. | Ferrite (%) | Martensite and tempered martensite (%) | Remaining structure (%) | $\sigma/M_{ave}$ | Circle-equivalent diameter of region with Mn concentration of higher than ($Mn_{ave}$ + 1.3σ) (μm) | Tensile strength (MPa) | Total elongation (%) | Hydrogen embrittlement resistance | Note |
|---|---|---|---|---|---|---|---|---|---|
| K-2 | 0.0 | 99.7 | 0.3 | 0.37 | 8.7 | 1,336 | 10.5 | ○ | Example |
| L-2 | 0.0 | 99.6 | 0.4 | 0.60 | 4.4 | 1,465 | 10.1 | ○ | Example |
| M-2 | — | — | — | — | — | — | — | — | — |
| N-2 | 0.0 | 95.4 | 4.6 | 0.28 | 1.7 | 1,648 | 9.5 | ○ | Example |
| O-2 | 2.4 | 90.0 | 7.6 | 0.97 | 1.5 | 1,598 | 8.6 | ◇ | Example |
| A-3 | 2.6 | 93.4 | 4.0 | **0.13** | **14.5** | 1,470 | 9.5 | x | Comparative Example |
| B-3 | 0.0 | 99.7 | 0.3 | 0.48 | 4.2 | 1,627 | 9.2 | ○ | Example |
| C-3 | 0.0 | 98.5 | 1.5 | **0.11** | 5.6 | 1,727 | 10.1 | x | Comparative Example |
| D-3 | 0.0 | 95.3 | 4.7 | 0.59 | 3.2 | 1,592 | 12.2 | ○ | Example |
| E-3 | 1.2 | 97.4 | 1.4 | **0.07** | **13.9** | 1,389 | 11.7 | x | Comparative Example |
| F-3 | 0.0 | 98.2 | 1.8 | 0.46 | 9.4 | 1,730 | 8.9 | ○ | Example |
| G-3 | **11.7** | **71.7** | 16.6 | 0.32 | 5.4 | **1,168** | 16.1 | ○ | Comparative Example |
| H-3 | 0.0 | 96.2 | 3.8 | **0.04** | **10.6** | 1,689 | 9.2 | x | Comparative Example |
| I-3 | 4.7 | 90.3 | 5.0 | 0.47 | 3.5 | 1,312 | 11.5 | ○ | Example |
| J-3 | 0.0 | 99.0 | 1.0 | 0.17 | 2.1 | 1,926 | 8.2 | ○ | Example |
| K-3 | 0.0 | 99.7 | 0.3 | 0.72 | 5.6 | 1,464 | 9.7 | ○ | Example |
| L-3 | 0.0 | 99.6 | 0.4 | 0.48 | 4.8 | 1,568 | 9.5 | ○ | Example |
| M-3 | 0.0 | 99.6 | 0.4 | **0.08** | **15.9** | 1,372 | 10.6 | x | Comparative Example |
| N-3 | 0.0 | 95.4 | 4.6 | **0.05** | 1.8 | 1,372 | 11 | x | Comparative Example |
| O-3 | 4.5 | 90.1 | 5.4 | 0.35 | 8.3 | 1,552 | 8.8 | ○ | Example |
| A-4 | 0.0 | 98.5 | 1.5 | 0.57 | 7.0 | 1,530 | 9.2 | ○ | Example |
| B-4 | 0.0 | 99.7 | 0.3 | 0.50 | 8.9 | 1,419 | 10.2 | ○ | Example |
| C-4 | 2.2 | 94.2 | 3.6 | 0.39 | 7.7 | 1,704 | 10.2 | ○ | Example |
| D-4 | 0.0 | 95.3 | 4.7 | 0.84 | 7.7 | 1,859 | 10.7 | ◇ | Example |
| E-4 | 4.7 | 90.4 | 4.9 | 0.16 | **15.3** | 1,303 | 12.4 | x | Comparative Example |
| F-4 | 3.6 | 91.1 | 5.3 | 0.20 | 2.1 | 1,432 | 10.4 | ○ | Example |
| G-4 | 0.0 | 93.6 | 6.4 | 0.43 | 6.4 | 1,515 | 12.9 | ○ | Example |
| H-4 | 3.6 | 91.3 | 5.1 | 0.88 | 2.1 | 1,529 | 9.9 | ◇ | Example |
| I-4 | 3.6 | 92.5 | 3.9 | **0.12** | **10.5** | 1,343 | 11.3 | x | Comparative Example |
| J-4 | 0.0 | 99.0 | 1.0 | 0.16 | 4.5 | 1,478 | 10.1 | ○ | Example |
| K-4 | 2.8 | 94.1 | 3.1 | 0.55 | **12.0** | 1,311 | 10.6 | x | Comparative Example |
| L-4 | 0.0 | 99.6 | 0.4 | **0.09** | **11.9** | 1,502 | 9.9 | x | Comparative Example |
| M-4 | 0.0 | 99.6 | 0.4 | 0.56 | 8.0 | 1,404 | 10.4 | ○ | Example |
| N-4 | 0.0 | 95.4 | 4.6 | 0.85 | 6.6 | 1,447 | 10.5 | ◇ | Example |
| O-4 | 4.1 | **86.8** | 9.1 | **0.05** | 3.0 | 1,323 | 10 | x | Comparative Example |

*Bold and underlined values are outside the scope of the present invention.

Referring to Table 4, in Examples C-2 and H-2, since the number of the rolling operations performed at a rolling reduction ratio of 20% or higher in the finish rolling was small, non-recrystallized austenite remained, as a result of which the circle-equivalent diameter of a region with a Mn concentration of higher than ($Mn_{ave}$+1.3σ) was increased, and the hydrogen embrittlement resistance was reduced. In Example J-2, since the pass interval between the rolling operations performed at a rolling reduction ratio of 20% or higher in the finish rolling was short, non-recrystallized austenite remained, as a result of which the circle-equivalent diameter of a region with a Mn concentration of higher than ($Mn_{ave}$+1.3σ) was increased, and the hydrogen embrittlement resistance was reduced. In Example M-2, due to the high coiling temperature, an internal oxide layer was formed in the surface layer of the hot-rolled sheet, and cracks were generated on the steel sheet surface in the subsequent treatment. Therefore, the analysis of the structure and the evaluation of the mechanical properties were not performed. In Example A-3, since the time between the termination of finish rolling and the start of cooling was long, ferrite transformation in the cooling process after the finish rolling was inhibited, and this caused coarsening of the pearlite structure, as a result of which the grain size of Mn-concentrated parts was increased, and the hydrogen embrittlement resistance was reduced.

In Example C-3, due to the high annealing temperature, the Mn-concentrated parts formed in the hot-rolled sheet were dispersed, as a result of which [σ≥0.15 $Mn_{ave}$] was not satisfied, and the hydrogen embrittlement resistance was reduced. In Example E-3, since the finish-rolling termination temperature was high, ferrite transformation in the cooling process after the finish rolling was inhibited, as a result of which the grain size of Mn-concentrated parts was increased, and the hydrogen embrittlement resistance was reduced. In Example G-3, the amount of generated austenite was small due to the low annealing temperature, and the tensile strength was reduced. In Example H-3, since the time between the termination of finish rolling and the start of cooling was short, non-recrystallized austenite remained, as a result of which the circle-equivalent diameter of a region with a Mn concentration of higher than ($Mn_{ave}$+1.3σ) was increased, and the hydrogen embrittlement resistance was reduced. In Example M-3, since the finish-rolling start temperature was low, non-recrystallized austenite remained in the same manner, as a result of which the circle-equivalent diameter of a region with a Mn concentration of higher than ($Mn_{ave}$+1.3σ) was increased, and the hydrogen embrittlement resistance was reduced.

In Example N-3, pearlite transformation did not occur due to the low coiling temperature, as a result of which [σ≥0.15 $Mn_{ave}$] was not satisfied, and the hydrogen embrittlement resistance was reduced. In Example E-4, since the average cooling rate after the finish rolling was low, the pearlite structure was coarsened, as a result of which the grain size of Mn-concentrated parts was increased, and the hydrogen embrittlement resistance was reduced. In Example 1-4, since the finish-rolling start temperature was high, ferrite transformation in the cooling process after the finish rolling was inhibited, as a result of which the grain size of Mn-concentrated parts was increased, and the hydrogen embrittlement resistance was reduced. In Example K-4, since the finish-rolling termination temperature was low, non-recrystallized austenite remained, as a result of which the circle-equivalent diameter of a region with a Mn concentration of higher than ($Mn_{ave}$+1.3σ) was increased, and the hydrogen embrittlement resistance was reduced. In Example L-4, since the pass interval between the rolling operations performed at a rolling reduction ratio of 20% or higher in the finish rolling was long, ferrite transformation in the cooling process after the finish rolling was inhibited, as a result of which the grain size of Mn-concentrated parts was increased, and the hydrogen embrittlement resistance was reduced. In Example 0-4, pearlite transformation did not occur due to the high average cooling rate after the finish rolling, as a result of which [a 0.15 $Mn_{ave}$] was not satisfied, and the hydrogen embrittlement resistance was reduced.

In contrast to the above, in all of Examples according to the present invention, a steel sheet having a high strength and excellent hydrogen embrittlement resistance was obtained particularly by controlling the hot rolling, the coiling, and the annealing as appropriate.

FIG. 1 is a graph showing the relationship between the standard deviation of Mn concentration and the circle-equivalent diameter of Mn-concentrated region, which affect the hydrogen embrittlement resistance of the steel sheets in Examples 1 and 2. As apparent from FIG. 1, it is understood that a steel sheet having excellent hydrogen embrittlement resistance can be obtained by controlling the standard deviation σ of Mn concentration to be 0.15 $Mn_{ave}$ or larger and the circle-equivalent diameter of a region with a Mn concentration of higher than ($Mn_{ave}$+1.3σ) to be less than 10.0 μm.

According to the new findings of the present inventors, a desired steel sheet can be produced in a more stable manner by, for example, arranging a region where, at the time of coiling a steel sheet after hot rolling, cooling water is intentionally not applied to the hot-rolled steel sheet, and thereby temporarily maintaining the temperature of this hot-rolled steel sheet. This is believed to be because, by allowing ferrite structure to grow at austenite grain boundaries, the amount of the above-described austenite grain boundaries not generating ferrite transformation can be reduced, as a result of which coarsening of pearlite structure can be inhibited.

The invention claimed is:

1. A steel sheet, having a chemical composition comprising, by mass %:

C: 0.15 to 0.40%;
Si: 0.01 to 2.00%;
Mn: 0.10 to 5.00%;
P: 0.0001 to 0.0200%;
S: 0.0001 to 0.0200%;
Al: 0.001 to 1.000%;
N: 0.0001 to 0.0200%;
Co: 0 to 0.50%;
Ni: 0 to 1.00%;
Mo: 0 to 1.00%;
Cr: 0 to 2.000%;
O: 0 to 0.0200%;
Ti: 0 to 0.500%;
B: 0 to 0.0100%;
Nb: 0 to 0.500%;
V: 0 to 0.500%;
Cu: 0 to 0.500%;
W: 0 to 0.100%;
Ta: 0 to 0.100%;
Sn: 0 to 0.050%;
Sb: 0 to 0.050%;
As: 0 to 0.050%;
Mg: 0 to 0.0500%;
Ca: 0 to 0.050%;
Y: 0 to 0.050%;
Zr: 0 to 0.050%;
La: 0 to 0.050%;
Ce: 0 to 0.050%; and
a balance of Fe and impurities,
wherein
the steel sheet comprises, by area ratio:
ferrite: 5.0% or less; and
a total of martensite and tempered martensite: 90.0% or more, wherein when there is a balance structure, the balance structure is composed of at least one of bainite, pearlite, and retained austenite,
a standard deviation σ of Mn concentration satisfies a 0.15 $Mn_{ave}$ (wherein, $Mn_{ave}$ represents an average Mn concentration), and
a region with a Mn concentration of higher than ($Mn_{ave}$+1.3σ) has a circle-equivalent diameter of less than 10.0 μm.

2. The steel sheet according to claim 1, comprising one or more of:

Co: 0.01 to 0.50%;
Ni: 0.01 to 1.00%;
Mo: 0.01 to 1.00%;
Cr: 0.001 to 2.000%;
O: 0.0001 to 0.0200%;
Ti: 0.001 to 0.500%;
B: 0.0001 to 0.0100%;
Nb: 0.001 to 0.500%;
V: 0.001 to 0.500%;
Cu: 0.001 to 0.500%;
W: 0.001 to 0.100%;
Ta: 0.001 to 0.100%;
Sn: 0.001 to 0.050%;
Sb: 0.001 to 0.050%;
As: 0.001 to 0.050%;
Mg: 0.0001 to 0.0500%;
Ca: 0.001 to 0.050%;
Y: 0.001 to 0.050%;
Zr: 0.001 to 0.050%;
La: 0.001 to 0.050%; and
Ce: 0.001 to 0.050%.

* * * * *